US005264066A

United States Patent [19]

Lundell

[11] Patent Number: 5,264,066

[45] Date of Patent: Nov. 23, 1993

[54] TIRE LABELING APPARATUS

[75] Inventor: Dennis A. Lundell, Uniontown, Ohio

[73] Assignee: The Goodyear Tire & Rubber Company, Akron, Ohio

[21] Appl. No.: 710,061

[22] Filed: Jun. 4, 1991

[51] Int. Cl.[5] ..... B65C 9/40

[52] U.S. Cl. ..... 156/361; 156/362; 156/363; 156/541; 156/542; 156/566

[58] Field of Search ..... 156/361, 362, 363, 540, 156/541, 542, 566

[56] References Cited

U.S. PATENT DOCUMENTS

| | | | |
|---|---|---|---|
| 2,880,538 | 4/1959 | Autem | 156/361 |
| 3,024,557 | 3/1962 | Frenkel et al. | 156/542 |
| 3,450,590 | 6/1969 | LaMers | 156/540 |
| 3,645,832 | 2/1972 | Sauer | 156/541 |
| 3,676,257 | 7/1972 | Ingalls | 156/542 |
| 3,729,362 | 4/1973 | French et al. | 156/363 |
| 3,775,219 | 11/1973 | Karlson et al. | 156/363 |
| 3,960,641 | 6/1976 | Pederson | 156/519 |
| 4,010,354 | 3/1997 | Apicella, Jr. et al. | 235/61.6 |
| 4,026,754 | 5/1977 | Bogdanski et al. | 156/521 |
| 4,108,706 | 8/1978 | Brands et al. | 156/384 |
| 4,132,583 | 2/1979 | Hodgson | 156/351 |
| 4,175,993 | 11/1979 | Robertson | 156/234 |
| 4,253,902 | 3/1981 | Yada | 156/361 |
| 4,612,079 | 9/1986 | Ostrow | 156/497 |
| 4,657,622 | 4/1987 | Paules | 156/361 |
| 4,696,707 | 9/1987 | Lewis et al. | 156/361 |
| 5,024,718 | 6/1991 | Hansen | 156/475 |

FOREIGN PATENT DOCUMENTS

| | | |
|---|---|---|
| 0364837 | 4/1990 | European Pat. Off. . |
| 2308373 | 9/1974 | Fed. Rep. of Germany . |
| 2074170 | 10/1971 | France . |
| 2529167 | 12/1983 | France . |
| 2581363 | 11/1986 | France . |
| 2-238933 | 9/1990 | Japan . |

OTHER PUBLICATIONS

Patent Abstracts of Japan, vol. 10, No. 33 (M-452)(2090) dated Feb. 1986 & Relating to JP-A-6-0-187539A, Kawatsune Shiyouten K.K.

*Primary Examiner*—David A. Simmons
*Assistant Examiner*—W. J. Matney, Jr.
*Attorney, Agent, or Firm*—T. P. Lewandowski

[57] ABSTRACT

A tire labeling apparatus feeds labels that are releasably adhered to a carrier web from a supply reel to a label dispensing station where the labels are transferred one at a time from the web to an application roller. At the dispensing station, the carrier web is tightly reversely bent to assist in sequentially "peeling" labels therefrom; spent web material is withdrawn from the dispensing station and collected on a collection reel; and, each newly "peeled" label is subjected to a jet of pressurized air that forces the indicia-carrying face of the label into engagement with a curved, label-receiving portion of the circumference of the application roller. Holes open through the label-receiving portion of the application roller, and ambient air is drawn through these holes to generate air pressure differential forces that releasably retain each newly dispensed label in place on the application roller. As the application roller is moved between the dispensing station and the application station, a resilient roller and a label reader move with it. At the application station, the application roller transfers the one label that it carries to a rotating bead portion of a tire; the resilient roller assures that each newly applied label conforms to the curved shape of the tire bead portion to which it is applied; and, the label reader reads the label's indicia.

24 Claims, 14 Drawing Sheets

TIRE LABELING APPARATUS

BACKGROUND OF THE INVENTION

1. Field of the Invention

The present invention relates generally to an apparatus for withdrawing labels that are releasably adhered to a carrier web for applying a separate label to each of a series of rotating articles such as tires. More particularly, the present invention relates to apparatus for dispensing labels one-at-a-time from a supply reel of web-carried labels, with each sequential label being peeled from its carrier web and transferred to a curved, circumferentially extending surface portion of an application roller at a dispensing station, with the application roller being moved from the dispensing station to an application station to position and apply the label it carries to a rotating bead surface portion of a tire, with a resilient roller being provided adjacent the application roller to fully conform each newly applied label to the curved shape of the tire portion to which it is applied, and with a label reader checking proper application of each label before the application roller is permitted to be repositioned in the dispensing station to receive the next-to-be-applied label.

2. Prior Art

In the manufacture or "building" of tires, often it is desired to affix small indicia-carrying labels to tires at a relatively early stage while they are being "built." The unique identification label that each tire carries can be used, for example, to link each tire to certain records that are kept regarding tire model, size and/or other aspects of its manufacturing history.

A preferred location for the positioning of an identification label on a tire is on a curved exterior surface of a bead of the tire. Such a location has the advantage of permitting the label to be conspicuous so as to be easily found and read during tire manufacture and at other times before the tire is put into service; and, it has the further advantage of causing the label to be concealed from view when the tire is put into service (i.e., the rim of a wheel onto which the tire is mounted will overlie and hide the label so that the label will not distract from the appearance of the tire when in service). Still another advantage that results from positioning the label on a curved bead surface of a tire is that the label can be put in place on the tire relatively early during the process of "building" the tire inasmuch as curved exterior bead surface portions of a tire tend to be finalformed ahead of other exterior surface portions of the tire.

A preferred time to apply an identification label to a tire is promptly after the curved bead surface area that is to receive the label has been formed at a workstation of a "tire building machine" where the tire is being "built." One such time is immediately after opposed ends of a tubular ply-and-innerliner assembly (i.e., an assembly that is formed during initial steps that typically are employed during the building of a tire) have been "turned up" so as to extend about and encapsulate stranded bead members that cooperate with the "turned up" end regions to form the "beads" of the tire that is being built. If possible, a preferred time to apply an identification label is while some other step of the tire building process is underway, whereby productivity at a workstation of a tire building machine will not be caused to diminish due to delays that are introduced by labeling procedures.

Previously proposed labeling apparatus typically has been characterized by one or more drawbacks that render such apparatus unsuitable for use in reliably effecting the application of labels to tires that are being built at a workstation of a tire building machine. Many prior proposals call for apparatus that is too large to access a curved rotating bead surface to apply a label thereto, and/or that operates in ways that are not acceptable if label applications are to be effected rapidly, reliably and safely. Many prior proposals provide apparatus that, if used to effect the application of a label to a rotating bead surface of a tire that is being built at a workstation of a tire building machine would necessitate that the tire manufacturing process be slowed, stopped or otherwise undesirably disturbed during label application. Many prior proposals provide apparatus that is not capable of working with a relatively stiff, wear-resistant label to properly conform the shape of the label to the complexly curved character of a rounded bead surface that is being rotated by the drum of a tire building machine. Most previously proposed labeling apparatus offers provides no capability to "read" a label substantially immediately after it has been put in place to confirm that a proper application of the label has been effected.

Stated in another way, most prior proposals for labeling apparatus are found to be deficient in providing apparatus that satisfies one or more of the needs that are addressed by the present invention, namely the relatively specialized needs that are encountered in a tire building environment for effecting rapid, delay-free application of identification labels to tires that are being built, with relatively stiff labels being applied and conformed to the complexly curved configuration of an exterior bead surface that is rotating about a drum of a tire building machine, with each label being "read" substantially immediately after it is put in place to confirm that the label has been properly applied and positioned, with the application apparatus providing minimal intrusion into the vicinity of the workstation, and with prompt withdrawal of the application apparatus from the immediate vicinity of the workstation being effected after each use, whereby the application apparatus poses no obstacle to a continuation of production at a workstation where a tire is being built.

SUMMARY OF THE INVENTION

The present invention addresses the foregoing and other needs and drawbacks and of the prior art by providing a novel and improved label applying apparatus that is particularly well suited for use at a workstation where tires are being manufactured or "built," such as the workstation of what is referred to as a "tire building machine."

In accordance with the preferred practice of the present invention, a tire labeling apparatus is provided that 1) feeds a label-carrying web from a supply reel along a path of travel to a label dispensing station, 2) transfers labels one at a time from the web to an application roller at the dispensing station, 3) moves the application roller to an application station wherein the application roller engages a rotating bead portion of a tire that is being built at a workstation of a tire building machine to apply the label to the rotating bead portion, 4) conforms the newly-applied label to the complexly curved configuration of its underlying bead surface, 5) reads the newly applied label, 6) withdraws and repositions the application roller at the dispensing station to receive the next-dispensed label so that the process can be repeated when the next tire is being built, and 7) collects spent web material on a take-up reel.

Apparatus that embodies the preferred practice of the present invention is particularly well suited for use with relatively stiff labels that are removably adhered to a carrier web, that are deliverable one-at-a-time to a label dispensing station by feeding the carrier web from a supply reel to the dispensing station, and that are easily "peeled" away from the carrier web as by reversely bending the carrier web about a blunt-nosed "peel bar" that is located at the dispensing station. Relatively stiff, wear-resistant indicia-carrying labels formed from polyester covered paper that is printed with a bar code preferably are employed, with the labels being arranged in abutting end-to-end engagement along a waxed-paper web for sequential delivery to the label dispensing station.

A feature of apparatus that embodies the preferred practice of the invention is that only a relatively small carriage that mounts an application roller, a resilient roller and a label reader is moved into close proximity with portions of a tire that is being "built" at a workstation of a "tire building machine." By this arrangement, components that occupy only a minimum of space are brought into the immediate vicinity of a tire-building workstation. Moreover, the brief period of time that such components need to be present at the workstation can be coordinated with tire building operations that are being carried out at the workstation so that the application of an identification label does not necessitate that the building of the tire be stopped, slowed or otherwise undesirably interfered with.

A further feature of apparatus that embodies the preferred practice of the invention resides in the closely spaced positioning of a carriage-mounted application roller and a resilient roller that cooperate to carry out a desired type of plural-step label "affixing" function. The application roller "picks up" one label at a time at the dispensing station; the carriage on which the application roller and the resilient roller is mounted moves to bring the application roller into engagement with a rotating curved bead surface to which the label is to be applied; the application roller transfers the label to the rotating curved bead surface to begin affixing the label thereto; and, the resilient roller engages and firmly presses the label so as to conform its shape to that of the complexly curved bead surface to complete the affixing function. Thus, the "affixing" of the label to a curved bead surface is carried out in essentially a two-step, two-roller type of operation.

Still another feature of apparatus that embodies the preferred practice of the invention resides in the provision and use that is made of a carriage-carried label reader that is moved toward and away from the application station together with the application roller and the resilient roller. The label reader is positioned quite close to the resilient roller to "read" a newly applied label almost the instant that the label has been final-pressed into place by the resilient roller. In normal operation, a quick "read" is successfully achieved of a newly applied label almost as soon as the label moves out of engagement with the resilient roller, whereupon a signal is generated to retract the carriage. However, if the reader does not successfully achieve a "read" of the newly applied label during the first revolution of the label-carrying tire portion, the application roller and the resilient roller are held in engagement with the rotating curved bead surface so that during one or more subsequent revolutions of the label, these rollers again attempt to press the label properly into position. If after a predetermined number of revolutions expire without a successful "read" of the newly applied label being obtained, a signal is given to an operator to check the automated operation that is underway at the workstation in question so that whatever is needed in the way of corrective action can be taken.

A characteristic of preferred practice resides in the plural-step procedure that is utilized to reliably and precisely dispense a label at a label dispensing station. A further characteristic of preferred practice resides in the plural-step procedure that is utilized to position, apply, press-in-place and obtain a successful "read" of each label at an application station. Still another characteristic of preferred practice resides in the coordinated manner in which these two types of plural-step procedures are carried out by using an "application roller" 1) to receive a label at the dispensing station, 2) to transfer the label to the application station, and 3) to initiate the process of "affixing" the label at the application station.

Other features and advantages of the most preferred practice of the present invention best can be understood by providing the reader with a summary of the manner in which apparatus that embodies the best mode and preferred practice of the invention preferably functions. Thus, in the paragraphs that follow within this section, selected features of preferred practice are described by summarizing the manner in which label dispensing and application preferably is effected.

At the label dispensing station, a plural-step procedure is carried out to transfer labels one at a time to a circumferentially extending exterior surface of what is referred to as an "application roller." As the label-carrying web approaches the label dispensing station, it moves along a pair of straight guide surfaces that align a lengthy reach of the web for feeding along a path that extends into the dispensing station in an "entrance plane" that is oriented to tangentially engage the cylindrical circumferentially extending exterior surface of the application roller. As each successive label enters the dispensing station, its feeding is halted to precisely position the label's leading edge at a predetermined "known" position.

When each new ready-to-dispense label has its feeding halted at the dispensing station, a number of things have taken place. While the entire length of the relatively stiff label has continued to move in the "entrance plane" described above, the carrier web portions that have transported the label to the dispensing station have begun executing a relatively tight "reverse bend" by beginning to move around a blunt-nosed formation (i.e., a "peel bar") that is positioned which at the dispensing station. However, only a very short length of the carrier web that has been in engagement with the new ready-to-dispense label has been separated or "peeled" from the leading edge portion of the label, whereby only about one sixteenth of an inch of leading edge region of the label is no longer adhered to the carrier web. It is the arrival at the predetermined "known" position of this leading edge portion of a ready-to-dispense label that is sensed by an optical sensing system, a signal from which is utilized to immediately halt the feeding of the web so that the leading edge of the ready-to-dispense label is caused to be stopped or "parked" at the predetermined "known" position.

Just as proper positioning (i.e., "parking") of a leading edge of a ready-to-dispense label is a prerequisite to the continuation of "dispening" at the dispensing station, so is proper positioning (i.e., "parking") of a particular arcuate segment of the cylindrical peripheral surface of the application roller—a segment that will be referred to as defining a "label-receiving surface." The "special" nature of the curved segment that defines the label-receiving surface has to do with the fact that a plurality of regularly spaced holes open through this curved surface segment to provide a means for retaining a label on the label-receiving surface once it has been brought into engagement therewith—as will be explained shortly.

Returning briefly to the positioning or parking of the application roller so that the label receiving surface is in a predetermined or "known" position, at least one "proximity sensor" depends alongside the application roller when the application roller is in the dispensing station (i.e., the application roller has not been moved out of the dispensing station by the carriage that supports the application roller). At least one "trigger" formation is carried on a side portion of the application roller and is configured to move closely into proximity with the proximity sensor when the orientation of the application roller about its axis of rotation is such that the label receiving surface has moved to a predetermined "known" position where it desirably is stationed when dispensing of a label onto the label-receiving surface is to proceed. Thus, a signal from the proximity sensor is used to halt the rotation of the application roller at an angular position wherein the label-receiving surface is ready to be advanced concurrently with the feeding of a label so as to position the label directly onto the label-receiving surface.

During the building of tires, the steps that are carried out at a workstation of a tire building machine take time to implement. Thus, if the labeling apparatus of the present invention is being utilized to apply one label to each new tire being built at a workstation of a tire building machine, there will be intervals of time between occasions when the labeling apparatus is called upon to dispense and apply a label. During such intervals, the next-to-be-dispensed label is held at the aforedescribed predetermined or "known" position; and, the application roller is parked with its label-receiving surface in the aforedescribed predetermined or "known" position.

Once the labeling apparatus is called upon to dispense and apply a label, a pair of substantially identical capstan rollers (i.e., rollers that have the same diameter) are driven at the same speed of rotation by concurrently operating a pair of electrical clutches that concurrently drivingly interconnect spindles (that carry the capstan rollers) with a single, common "source of rotary energy" (preferably a motor-driven roller chain). One of these capstan rollers is in direct driving engagement with "spent" portions of web material that are held taut after they pass around the peel bar at the dispensing station. The other of the capstan rollers directly drivingly engages the cylindrical outer surface of the application roller. Thus, with the next-to-be-fed label starting from a predetermined "known" position, and with the application roller starting with its label-receiving surface in a predetermined "known" position, the web that feeds the label and the label-receiving surface are put into motion at identical speeds of movement by identical drive units—with the result being that the label is delivered onto the label-receiving surface in a highly reliable manner that assures "registry" of the label with the underlying label-receiving surface.

The holes that are formed through the label-receiving surface communicate through a hollow interior of the application roller with an evacuation passage that extends interiorally of a shaft that mounts the application roller for rotation. Ambient air is drawn through the holes and is evacuated through the hollow interior of the application roller and through the passage formed in the shaft so that, once a label portion has come into contact with the label-receiving surface, the label portion tends to be held in place on the label-receiving surface by differential air pressure forces.

As the tensioned carrier web moves a label into registry with the label-receiving surface, the label-receiving surface moves at the same speed alongside the indicia-carrying surface of the label so that, as the label is brought into registry with the label-receiving surface, the adhesive-carrying back surface of the label faces away from the application roller. During the process of dispensing a label onto the label-receiving surface, a jet-like flow of pressurized air is aimed at the adhesive-carrying side of the label to assist in bringing the indicia-carrying face of the label into firm seated engagement with the label-receiving surface.

Continued feeding of the label-carrying web is halted when enough of the web has been fed to assure that a "break line" or line of juncture between the presently-being-dispensed and next-to-be-dispensed labels should have separated from the carrier web; and, rotation of the application roller is continued to assure that a label that is presently being dispensed successfully pulls free from (i.e., separates from) the next-to-be-dispensed label. As rotation of the application roller continues (to position the label that it carries in a desired position for transfer to an application station—as will be discussed shortly), the feeding of the web preferably is resumed to position the leading edge of the next-to-be-dispensed label at the aforedescribed "known" position.

Feeding of the label-carrying web preferably is halted quite promptly and effectively, when desired, in a manner that maintains a desired tautness in the web in the vicinity of the dispensing station. Preferably, web feeding is halted by both stopping the rotation of the capstan roller that tensions spent portions of the web that have passed through the dispensing station, and by utilizing a fluid operated cylinder to clamp a label-carrying portion of the web between a resilient "bumper" and a guide surface that is used to direct the label-carrying web toward the dispensing station. A pinch roller is provided at the location of the web feeding capstan roller to clamp spent web material into firm contact with the web-feeding capstan roller. By this arrangement, portions of the carrier web located along web feed path portions on both sides of the dispensing station are stopped and held in place.

The capstan roller that engages the periphery of the application roller to "drive" the application roller while it is positioned at the dispensing station is used to move a newly dispensed label for about a third of a revolution beyond the angular position of the application roller wherein label separation from a next-to-be-fed label has taken place. The position to which the label that is carried by the application roller is moved is selected such that, when the carriage on which the application roller is mounted is moved to translate the application roller to the application station (where the application roller brings the label into contact with article surface portions that are to receive the label), the label will not be caused to immediately engage the article onto which it is to be applied. Stated in another way, the application roller positions the label it carries so that, when the application roller engages surfaces of the article that is to be labeled and quickly is "brought up to speed" therewith by virtue of such engagement, the label will have about three-fourths of a revolution to travel before it is pressed into engagement with rotating surface portions of the article.

While the application roller is positioned at the dispensing station, its rotary positioning is controlled by means of its engagement with an intermittently operated capstan that is clutched into and out of driving engagement with a roller chain that drives various web positioning components of the labeling apparatus. However, once the application roller moves away from the dispensing station, it withdraws from engagement with its positioning capstan and becomes "free rolling" so that, when it comes into engagement with a rotating tire bead at the application station, the application roller can, within less than a revolution, be brought quickly "up to speed." By this arrangement, when the label that is carried by the application roller comes into engagement with the rotating bead surface, the velocity of the label substantially matches the velocity of the bead surface—and, as a result, "affixing" of the label to the bead surface is initiated as portions of the adhesive-carrying side of the label are brought into engagement with the curved bead surface by the relatively rigid application roller.

To complete the "affixing" of the label to the complexly curved bead surface, a resilient roller that is positioned quite near to but spaced from the application roller engages the indicia-carrying surface of the label almost immediately after the label is disengaged by the application roller. Like the application roller, the resilient roller is caused to rotate while at the application station by virtue of its drivingly engaging the rotating bead surface. Unlike the application roller which is relatively rigid, however, the resilient roller deforms so as to conform to the shape of the complexly curved surface of the rotating bead; and, as the label passes between the "conformed" surface of the resilient roller and the complexly curved surface of the bead, the label is securely clamped and forced into conformance with the complexly curved surface of the rotating bead. As the adhesive that is carried by the label is pressed into engagement with the curved bead surface, the "affixing" of the label to the curved bead surface is completed.

Located near the resilient roller is the viewing window of a label reader. The label reader is supported on the same carriage that moves the application roller between the dispensing and application stations, and has its window aimed to enable it to effect a "read" of a newly affixed label almost immediately once such identification indicia as is carried by the label has moved away from the location of the resilient roller. As soon as a valid "read" of a newly applied label has been obtained, a signal is generated to retract the application roller, the resilient roller and the label reader from the application station so that the application roller can re-engage the positioning capstan at the dispensing station, and so that the application roller can be rotated by the capstan to position the label-receiving surface to underlie and receive the next-to-be-dispensed label as the next-to-be-dispensed label is peeled from the carrier web at the dispensing station.

Those who are skilled in the art will understand that the aforedescribed preferred form of carrying out the practice of the present invention need not be complied with in its entirety in order for a number of significant features of the invention to be used advantageously. It will therefore be understood that the foregoing description of certain features of preferred practice is not to be interpreted as limiting the scope of the accompanying claims, or as indicating that modifications of or deviations from the described practice necessarily signal the presence of significant departures from the spirit and scope of the claimed invention.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 1:
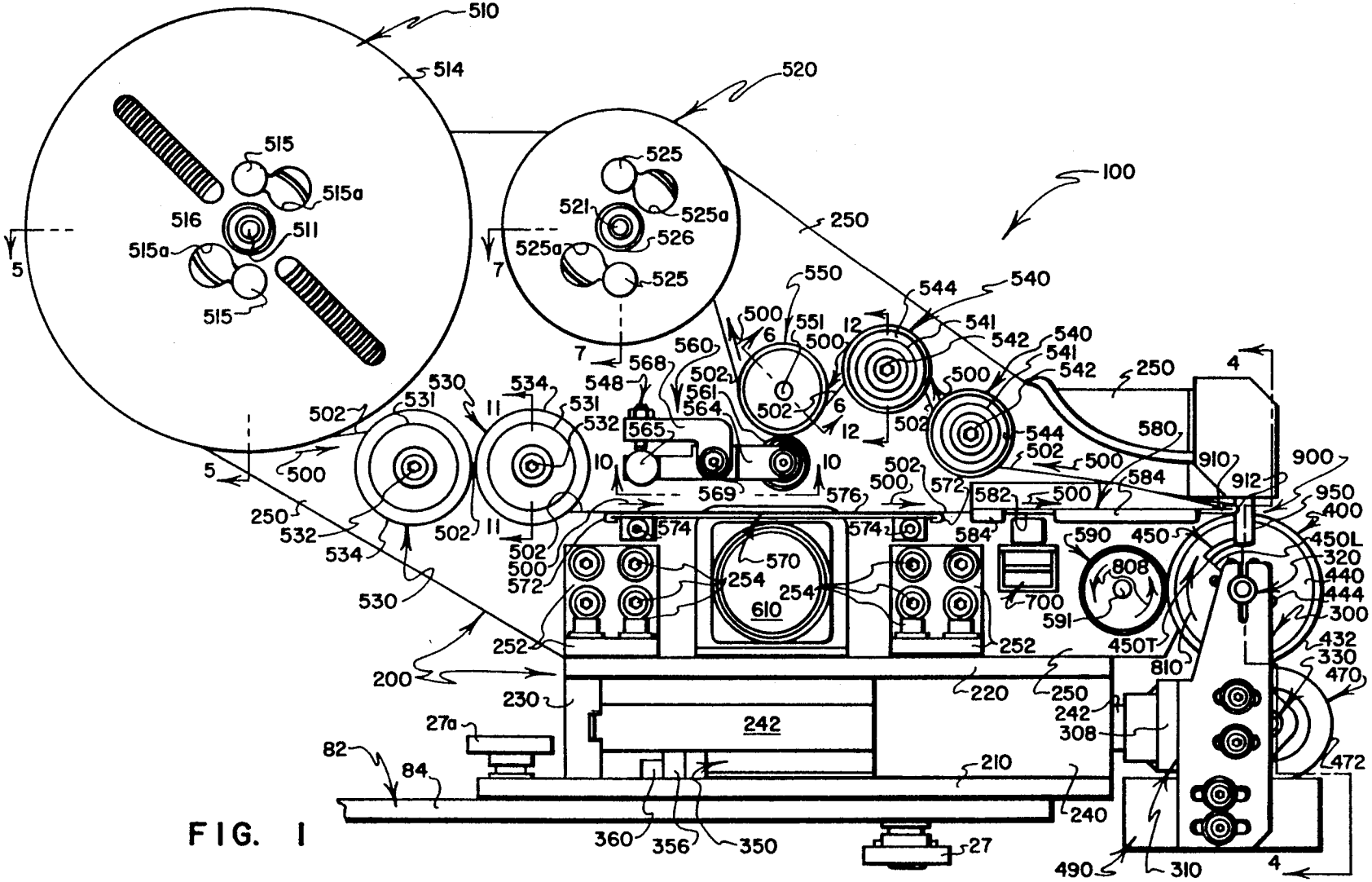
FIG. 1 is a left side elevational view of a tire labeling apparatus that embodies features of the preferred practice of the present invention, with the view showing a label application carriage in its retracted position wherein it positions an application roller at a label dispensing station, with the view having arrows that indicate the direction along a path of travel that is followed by a web of carrier material in being fed from a supply reel to the dispensing station and thence to a collection reel, and with the view showing only selected portions of an underlying support plate on which the labeling apparatus is supported.
Figure 2:
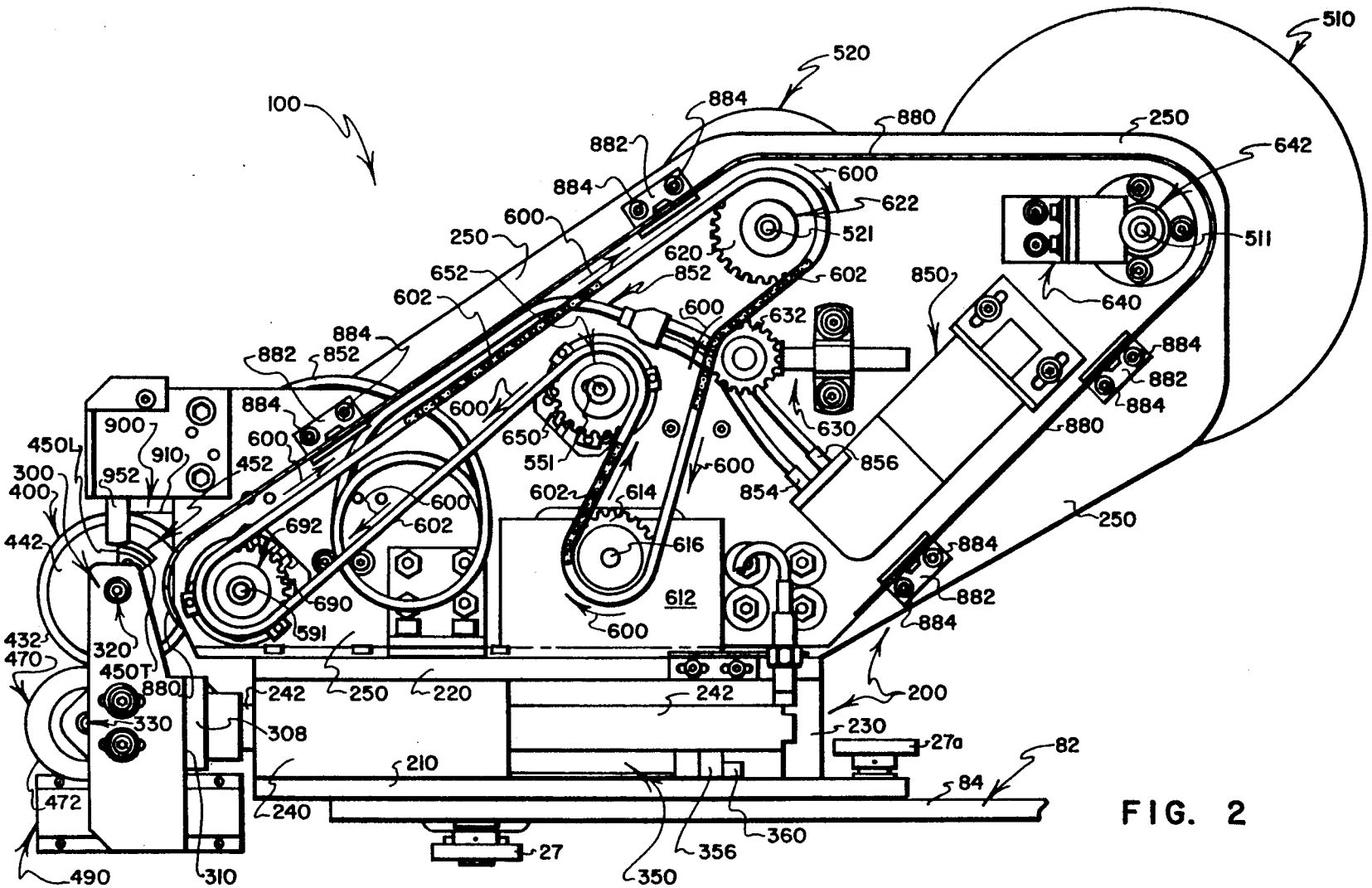
FIG. 2 is a right side elevational view thereof, with the view having arrows that indicate the direction of travel that is followed by a roller chain that drivingly interconnects several shaft-carried sprockets.
Figure 3:
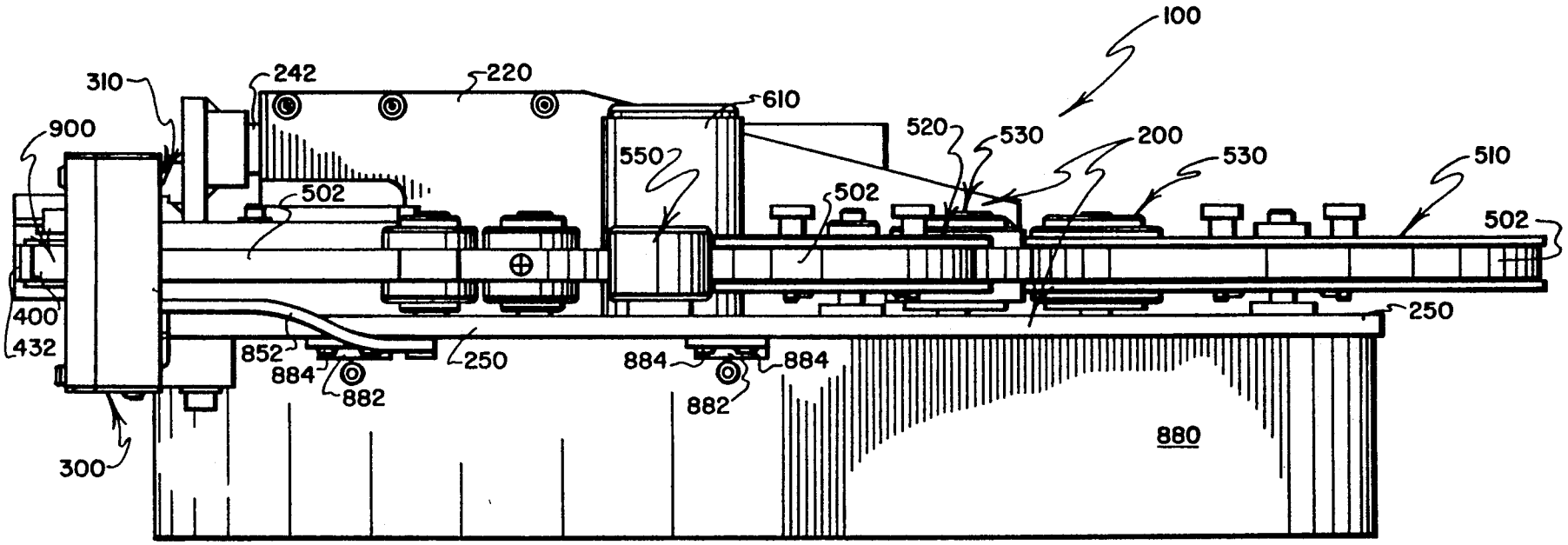
FIG. 3 is a top plan view thereof, but with all portions of the underlying support plate removed.

Referring to FIGS. 1-3, a tire labeling apparatus that embodies the preferred practice of the present invention is indicated generally by the numeral 100. While the apparatus 100 is depicted in FIGS. 1-3 (and in others of the views of the accompanying drawings) with selected components extending substantially horizontally or substantially vertically, it should be kept in mind that the apparatus 100 can be mounted for use in a variety of other orientations. While such terms as "horizontally extending," "vertically extending," "left," "right," "front" and "rear" are utilized in the description that follows, it will be understood that such terms are used merely to aid the reader in referring to features that are depicted in the accompanying drawings. A variety of orientations in which the tire labeling apparatus 100 typically can be mounted for use are discussed later herein, particularly in conjunction with the depictions of FIGS. 23-28.

In the top view of FIG. 3, what will be referred to as the "front" of the apparatus 100 is depicted toward the left; what will be referred to as the "rear" of the apparatus 100 is depicted toward the right; what will be referred to as the "left side" of the apparatus 100 is depicted in approximately the upper half of FIG. 3; and, what will be referred to as the "right side" of the apparatus 100 is depicted in approximately the lower half of FIG. 3. Thus, what is depicted in FIG. 1 will be referred to as the "left side" of the apparatus 100; and, what is depicted in FIG. 2 will be referred to as the "right side" of the tire labeling apparatus 100.

Figure 19:
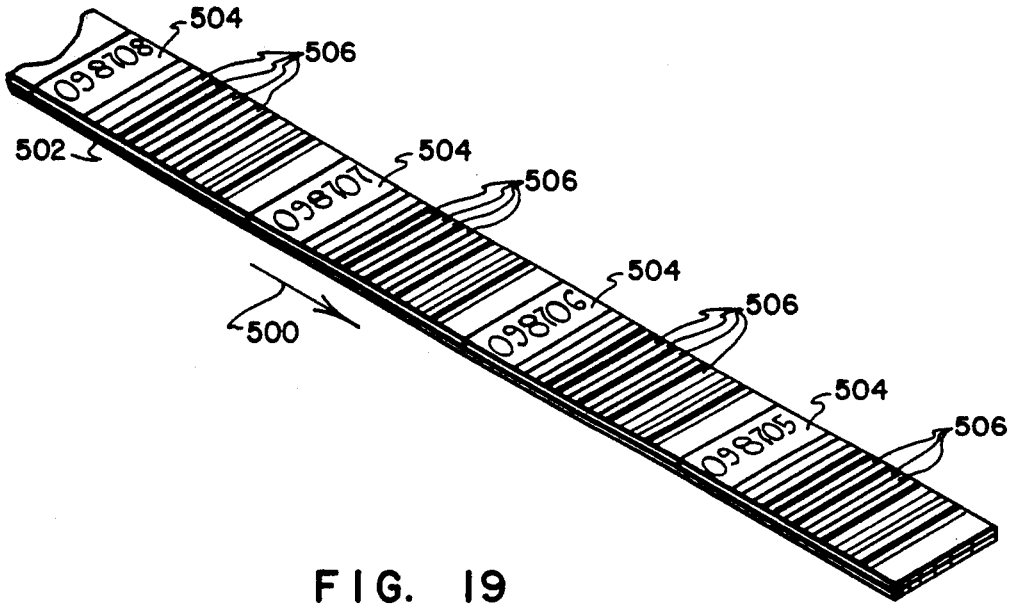
FIG. 19 is a perspective view of a carrier web having a plurality of generally rectangular labels releasably adhered to the web, with the labels being arranged end-to-end but with the material from which the labels are formed being severed at lines of juncture between abutting ends of adjacent labels, with the view showing principally the front face (i.e., the indicia-carrying surface) of the labels.
Figure 20:
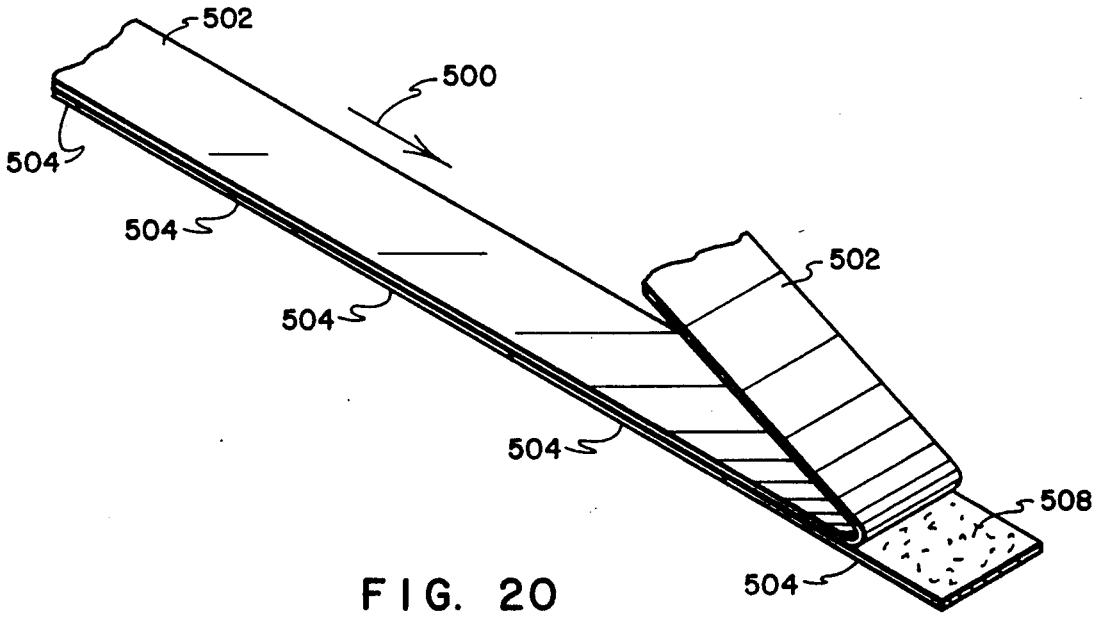
FIG. 20 is a perspective view similar to FIG. 19 but showing the back side of the carrier web, and showing a portion of the carrier web being put through a reverse bend to peel portions of one of the labels therefrom, and with back face portions (i.e., adhesive-carrying surface portions) of one of the labels being exposed to view.
Figure 21:
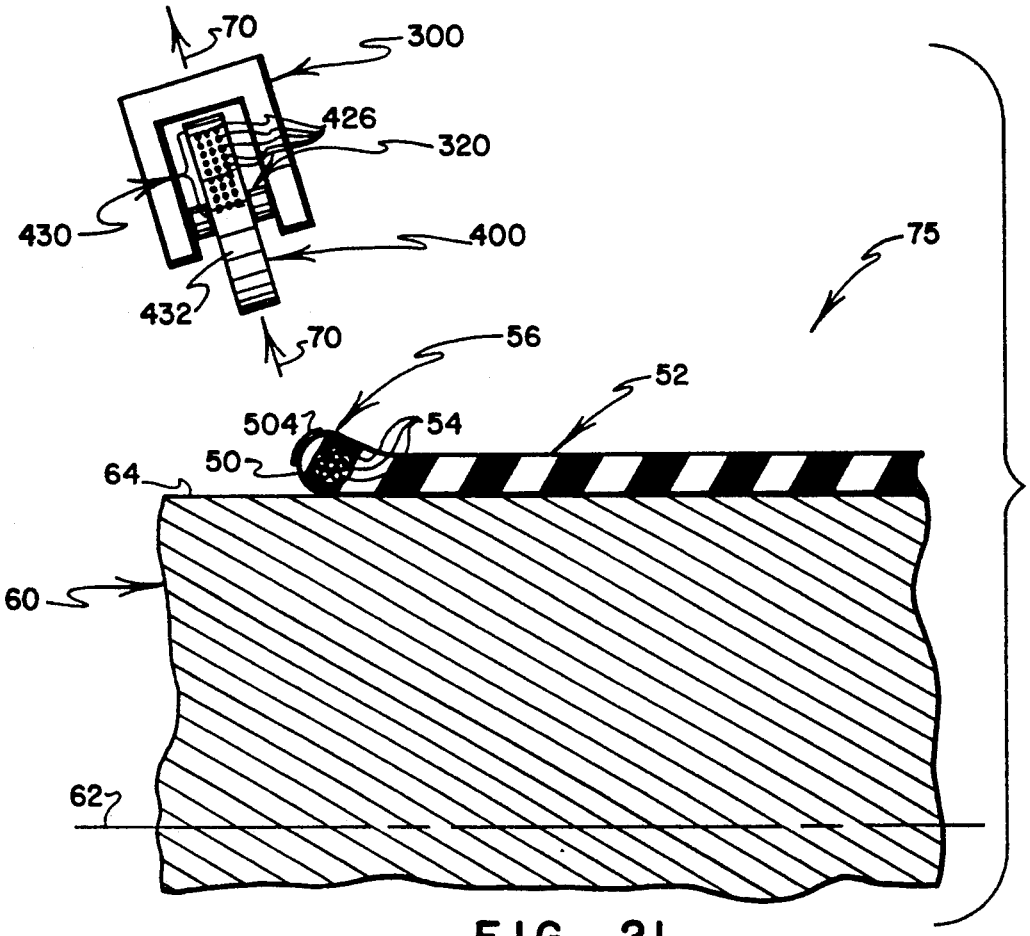
FIG. 21 is a schematic sectional view on an enlarged scale showing portions of a drum of a tire building machine together with tubular end portions of a tire that is being built on the drum, with the view also showing in cross-section a label that has been applied to a curved exterior bead surface, with the view showing portions of the application roller, and with arrows indicating a path of retraction movement that is followed by the application roller in withdrawing from the application station to the label dispensing station.
Figure 22:
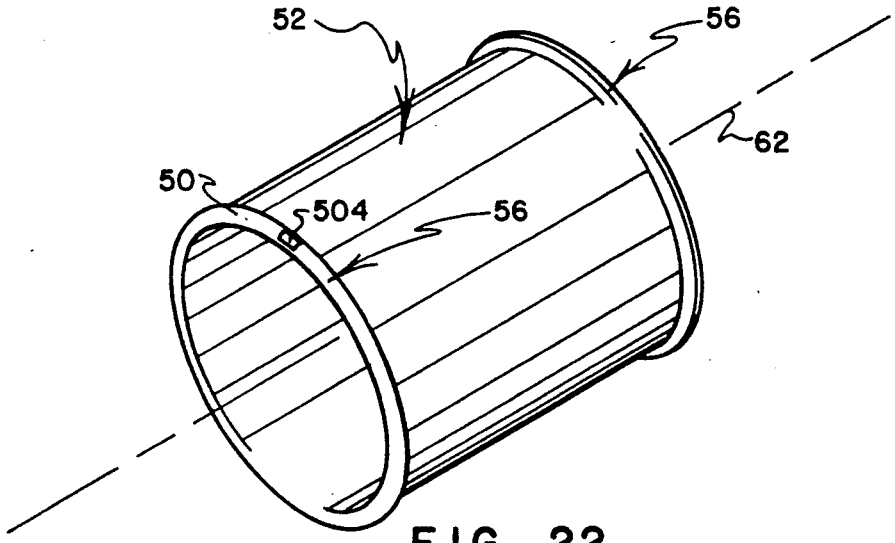
FIG. 22 is a perspective view, on a diminished scale illustrating the substantially tubular configuration of such portions of a partially built tire as have "beads" defined at opposed ends thereof, and with the view showing a label applied to a curved exterior bead surface of the tubular tire portions in accordance with the preferred practice of the present invention.

Before turning to a discussion of features of the tire labeling apparatus 100, reference is made first to FIGS. 19 and 20 which depict features of web-carried labels of the type that typically are applied to tire bead portions by the apparatus 100, second to FIGS. 21 and 22 which show labels in place on tire bead portions, and third to FIGS. 23-24 and 27-28 which illustrate selected components of first and second types of tire building machines with which the apparatus 100 can be utilized.

Referring to FIGS. 19 and 20, a length of carrier web material is indicated generally by the numeral 502. Labels 504 that are removably adhesively carried by the web 502 and are arranged in an end-to-end array along the web 502. Typically the material from which the web is formed is waxed paper that can be tensioned as needed to feed the label-carrying web from a supply reel to a dispensing station where the labels 504 are "peeled" from the web 502 one at a time so that each of the labels 504 can be applied to a bead surface portion of a tire that is being built at a workstation of a tire building machine. A strong but pliable waxed paper typically is used to form the web 502. Typically the labels 504 are formed from polyester covered paper that is printed with a bar code (and perhaps also with other indicia such as Arabic numerals), with the material of the labels 504 being selected to provide good heat resistance to assure that they will withstand the high temperature "cure" process to which a newly built tire is subjected. Also, the material from which the label is formed is selected to provide a good capability to retain printed indicia (such as the bar code indicia that is indicated in FIG. 19 by the numeral 506 as being applied to front surface portions of the labels 504), and a capability to be securely adhered to a tire bead portion utilizing a suitable adhesive that also can be used to removably adhere the labels 504 to the web 502 (some of the adhesive coating that is applied to back surface portions of one of the labels 504 is indicated in FIG. 20 by the numeral 508).

Typically the web has a width of about 9/16 inch, each label has a corresponding width of about 9/16 inch, and each label has a length of about 1¼ inch. However, as those who are skilled in the art readily will understand, features of the present invention are not restricted to working with labels or webs of any particular dimension. Likewise, while the labels 504 are depicted as being of substantially rectangular shape, features of the present invention can be utilized with labels that have shapes other than rectangular.

Figure 24:
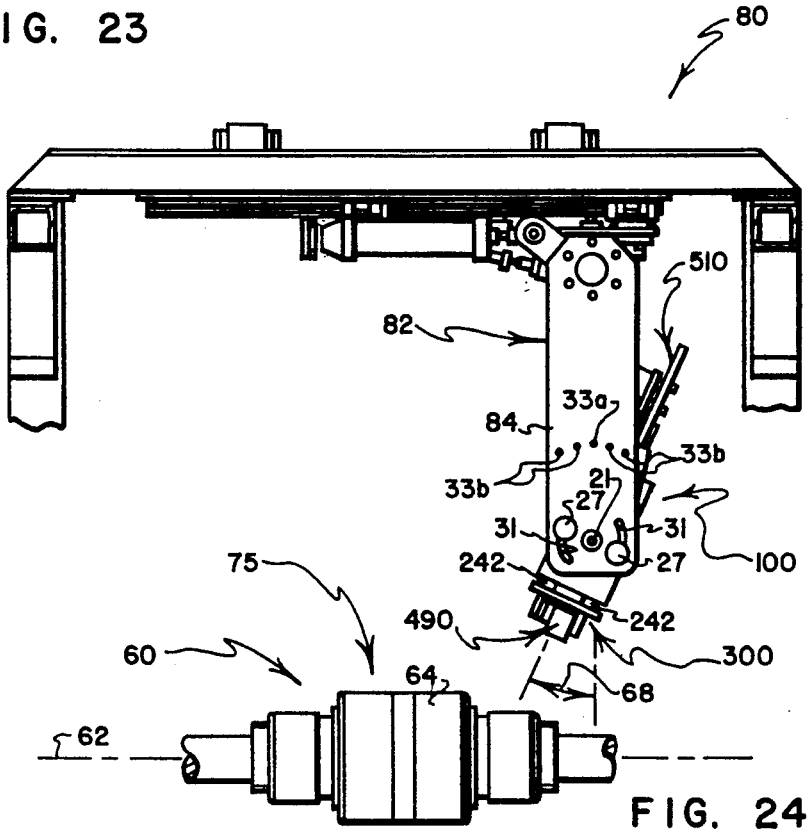
FIG. 24 is a front elevational view of portions thereof, as seen from a plane indicated by a line 24—24 in FIG. 23, but with the tire labeling apparatus moved from a "centered position" that is depicted in FIG. 23 to an inclined angle of orientation relative to the axis of the tire building drum of the tire making machine.

Referring to FIGS. 21 and 22, a label 504 is shown duly applied to a curved bead surface portion 50 of a substantially tubular-shaped assembly 52 of an innerliner and tire plys that has advanced to the tire building stage wherein cord-like materials 54 (see FIG. 21) have been encapsulated within "turned up" end regions of the innerliner-and-ply assembly 52. In FIG. 21, portions of the innerliner-and-ply assembly 52 are shown in cross section positioned about portions of a drum 60 of a tire building machine of the type that is depicted in FIG. 24. Also shown in FIG. 21 is an application roller 400 that is rotatably supported by portions of a movable carriage 300 (features of which will be described shortly in conjunction with a discussion of FIGS. 1–4). Arrows 70 indicate a direction of movement that typically is followed by the application roller 400 in withdrawing from the vicinity of a tire bead 56 after a label 504 has been applied to a curved surface 50 of the tire bead 56.

The complexly curved nature of the tire bead surface portion 50 is partially illustrated in FIG. 21, and is depicted more fully in FIG. 22. The complex nature of the curvature of the surface 50 of the bead 56 is derived not only from the fact that the surface portion 50 is "rounded" (as viewed in cross section in FIG. 21), but also from the fact that the surface portion 50 is arcuately curved to form the ring-like bead 56 that extends substantially concentrically about a central axis 62 of the partially completed tire assembly 52.

Figure 23:
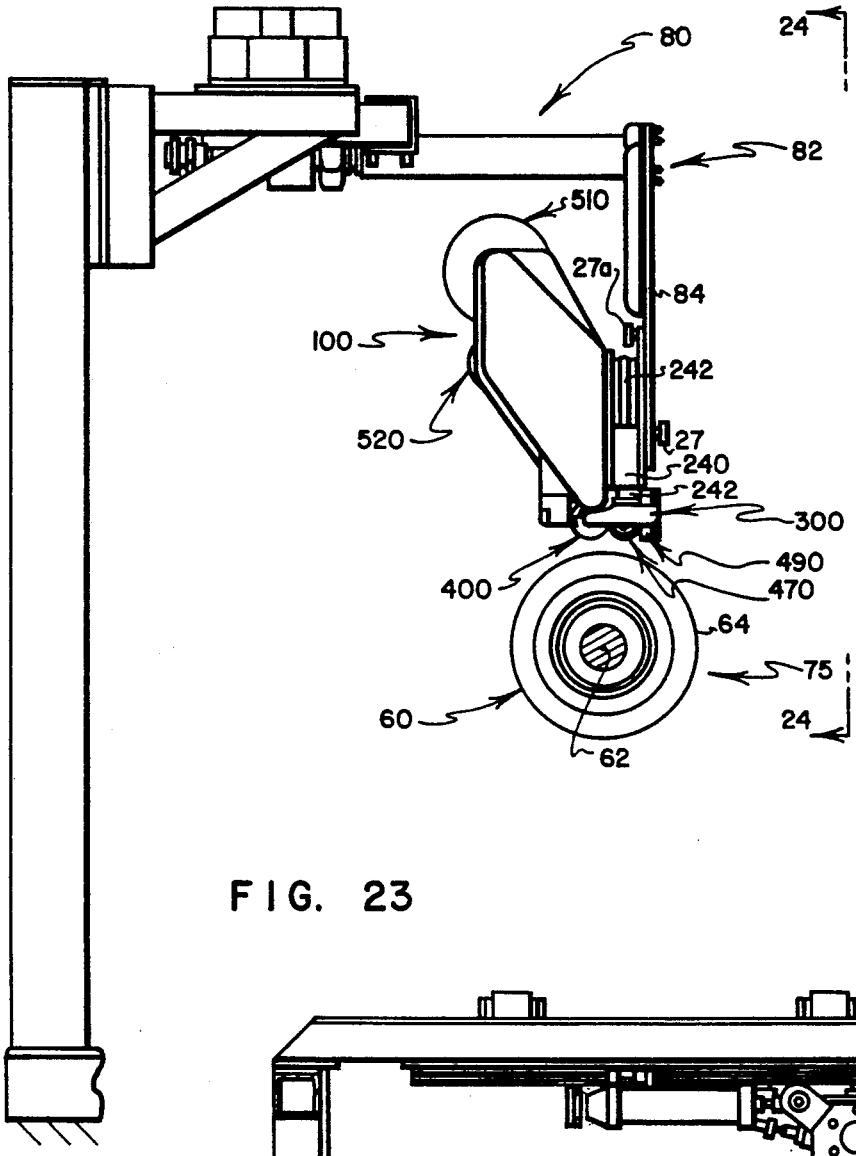
FIG. 23 is a side elevational view of portions of one form of tire building machine with the tire labeling apparatus supported above a workstation of the tire building machine.

Referring to FIGS. 23 and 24, portions of one form of a tire building machine (with which the labeling apparatus 100 typically can be used) are indicated generally by the numeral 80. The machine 80 has a tire building drum 60 that rotates about an axis 62 (it is the same "axis 62" that has been referred to previously in conjunction with a discussion of what is shown in FIG. 22). The drum 60 has an enlarged central portion 64 that is situated substantially centrally within a region that will be referred to as being a tire-building "workstation" of the machine 80. In FIGS. 23 and 24, the workstation of the machine 80 is indicated generally by the numeral 75.

Among portions of the machine 80 that extend about the workstation 75 is a movable carriage assembly 82. The carriage assembly 82 includes a plate 84 that underlies and supports the tire labeling apparatus 100. In FIG. 23, the tire labeling apparatus 100 is shown extending substantially vertically at a location above the workstation 75. In FIG. 24, the tire labeling apparatus 100 is shown moved by the carriage assembly 82 to near a right end region of the drum 60, with the tire labeling apparatus 100 being shown in an attitude that is inclined relative to the vertical, and with the angle of inclination being indicated by the arrow 68.

Figure 27:
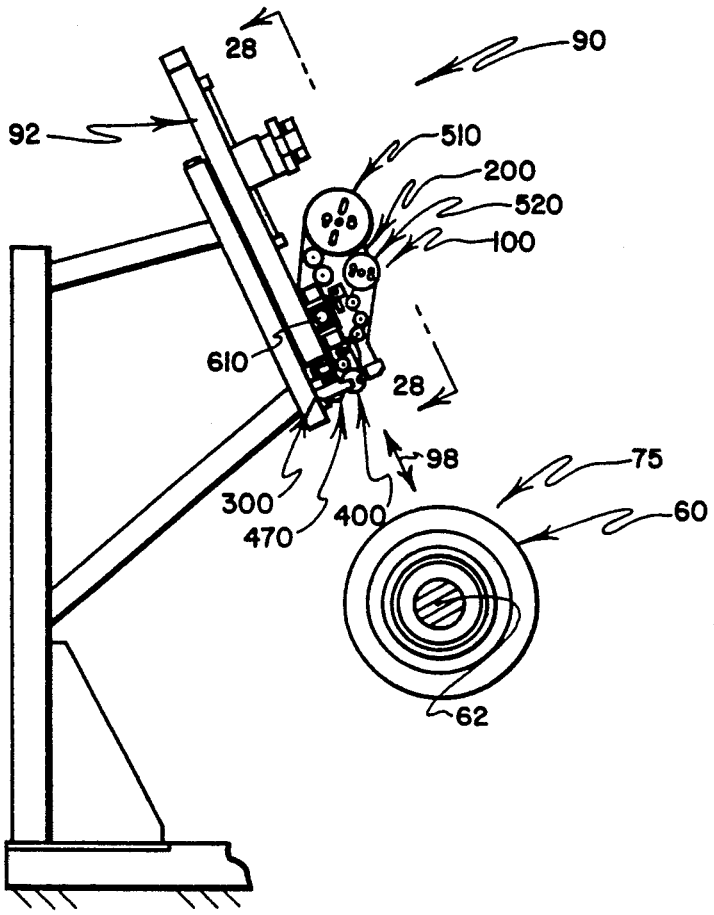
FIG. 27 is a side elevational view of portions of an alternate form of tire building machine with the tire labeling apparatus supported above and slightly behind a workstation of the machine, and with the tire labeling apparatus being in a "centered position;" and, FIG. 28 is a view of selected portions of the tire building machine of FIG. 27 as seen from a plane indicated by a line 28—28 in FIG. 27, but with the tire labeling apparatus oriented at an inclined angle.
Figure 28:
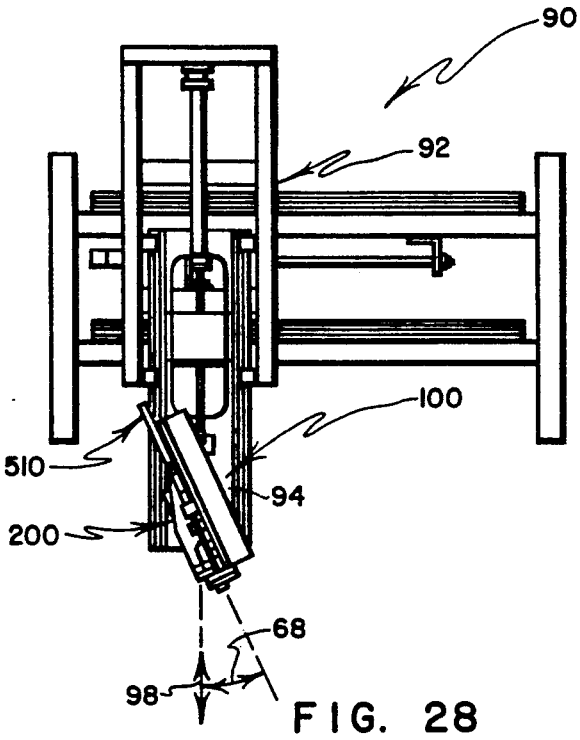

Referring to FIGS. 27 and 28, portions of another form of a tire building machine (with which the tire labeling apparatus 100 also can be used) are indicated generally by the numeral 90. The machine 90 has a tire building drum that also is indicated by the numeral 60 (see FIG. 27) which rotates about an axis 62 in the same manner as the drum 60 that is shown in FIG. 24 rotates about its axis 62 (see FIG. 24). The machine 90 has a workstation that is indicated generally by the numeral 75 in FIG. 27.

Among portions of the machine 90 that extend about the workstation 75 is a movable carriage assembly 92 that has a plate 94 (see FIG. 28) that underlies and supports the tire labeling apparatus 100. In FIG. 27, the tire labeling apparatus 100 is shown supported at a forwardly inclined attitude for being moved toward and away from the workstation 75 by movements of portions of the carriage 92 in directions indicated by an arrow 98. While the apparatus 100 is shown in FIG. 27 as being substantially aligned with the path 98 along which the carriage 92 moves in extending toward and retracting from the workstation 75, in FIG. 28 the apparatus 28 is shown inclined with respect to the travel path 98, with the angle of inclination being indicated by the arrow 68.

Figure 25:
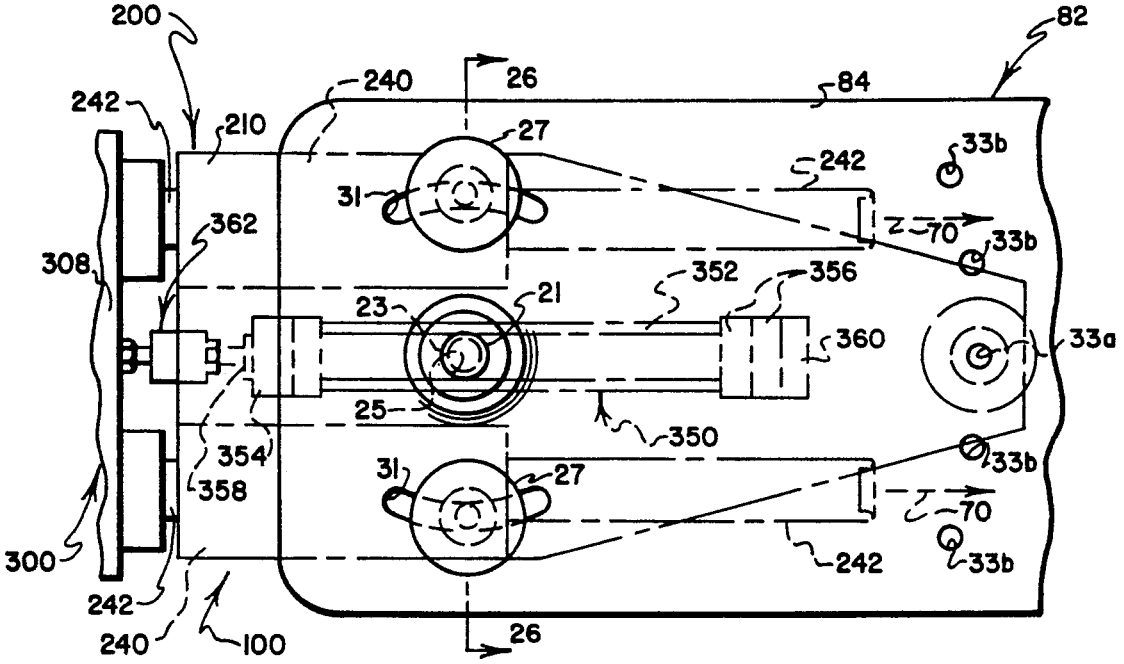
FIG. 25 presents an enlarged portion of the front elevational view of FIG. 24 but with the tire labeling apparatus returned to is "centered position," and with broken lines added to depict certain hidden features.
Figure 26:
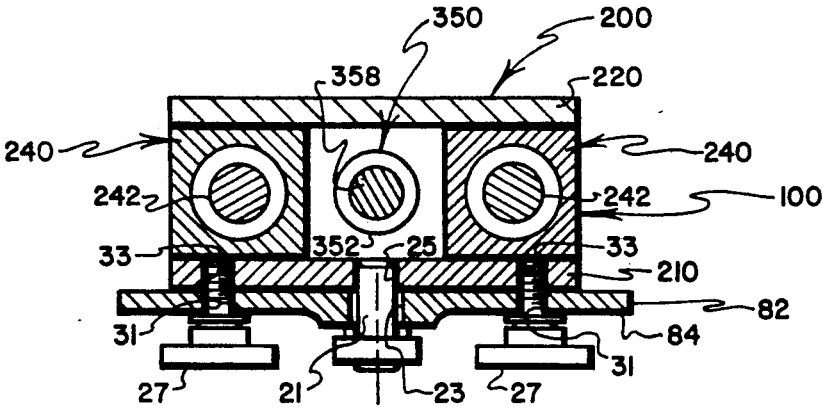
FIG. 26 is a sectional view of portions of the apparatus of FIG. 25, as seen from a plane indicated by a line 26—26 in FIG. 25.

The positioning of the tire labeling apparatus 100 in "inclined" positions (such as is depicted in FIGS. 24 and 28) and in "centered" positions (such as is depicted in FIGS. 23, 25 and 27) preferably is attended to simply by pivoting the apparatus 100 about a pivotal mount that is provided between the apparatus 100 and such supporting carriage assemblies as are indicated generally by the numerals 82 and 92 in FIGS. 23–26 and 27–28, respectively. Referring, for example to FIGS. 25 and 26, a pivotal mount is provided between the backing plate 84 of the carriage 82 and a base plate 210 of the apparatus 100 by means of a headed stub shaft 21 that extends into aligned holes 23, 25 that are formed in the plates 84, 210, respectively.

Locking of the apparatus 100 in a particular angular position relative to the plate 84 is effected by utilizing a plurality of knurled thumb screws 27 that extend through holes or slots 31 (see FIG. 25) that are formed in one or the other of the plates 84, 210 and are threaded into threaded holes 33 that are formed in the other of the plates 84, 210. Referring to FIG. 25, it will be seen that two knurled thumb screws 27 extend through curved slots 31 formed in the plate 84 and are threaded into holes 33 (see FIG. 26) that are formed in the base plate 210. Also, as is seen in FIG. 25 (and in side view in FIGS. 1 and 2), a third knurled thumb screw **27*a* is positioned in aligned holes 33*a* that are provided in the plates 210, 84 to secure the positioning of the labeling apparatus 100 relative to the carriage plate 84. Other positioning holes 33*b* are provided at spaced locations in the plate 84 to facilitate positioning the labeling apparatus at predetermined angles of inclination relative to the carriage plate 84**.

Returning now to a description of the tire labeling apparatus 100, and referring initially to FIGS. 1 and 2, many of the operating components of the tire labeling apparatus 100 are connected to and supported by a frame structure that is indicated generally by the numeral 200. The frame structure 200 includes lower and upper horizontally extending base plates 210, 220, and a main plate 250 that extends vertically upwardly from the upper base plate 220. Interposed between the lower and upper base plates 210, 220 are a spacer block 230 and a pair of ball bushing assemblies 240. The spacer block 230 extends transversely at a location that is near the rear end regions of the lower and upper base plates 210, 220, and is rigidly secured to the base plates 210, 220 by suitable fasteners (not shown).

Referring briefly to FIGS. 25 and 26, the ball bushing assemblies 240 extend in spaced parallel relationship along left and right overlying side portions of the lower and upper base plates 210, 220, with a fluid operated cylinder 350 extending therebetween. As is depicted by hidden lines in FIG. 25, the cylinder 350 has an elongate housing 352 which has opposed end regions 354, 356. A cylinder rod 358 extends from the front end region 354. A mounting block 360 connects the opposite end region 356 of the housing 352 to the lower base plate 210 by means of suitable fasteners (not shown).

Returning to FIGS. 1 and 2, the main plate 250 of the frame structure 200 has a front end region that extends for a short distance forwardly from the front end region of the upper base plate 220, and has a rear end region that extends upwardly and rearwardly for a relatively greater distance from the rear end region of the upper base plate 220. A plurality of right angle brackets 252 (two are shown in FIG. 1 and one is shown in FIG. 2) cooperate with threaded fasteners 254 to rigidly connect bottom portions of the main plate 250 to the upper base plate 220.

Figure 17:
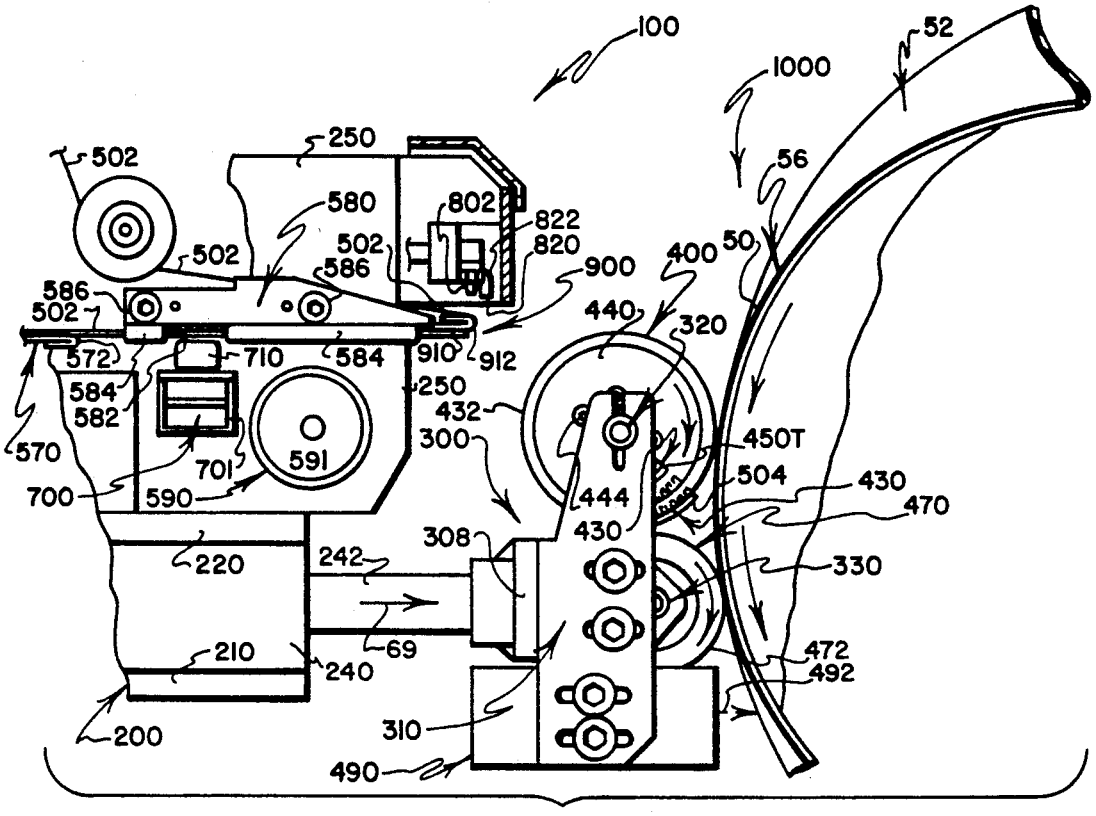
FIG. 17 is a left side elevational view similar to FIG. 15 but showing movement out of the dispensing station to an application station, with the view showing portions of a carriage that supports the application roller, an underlying resilient roller, and an underlying label reader, and with the application roller and the resilient roller being shown engaging a rotating tire bead surface.
Figure 18:
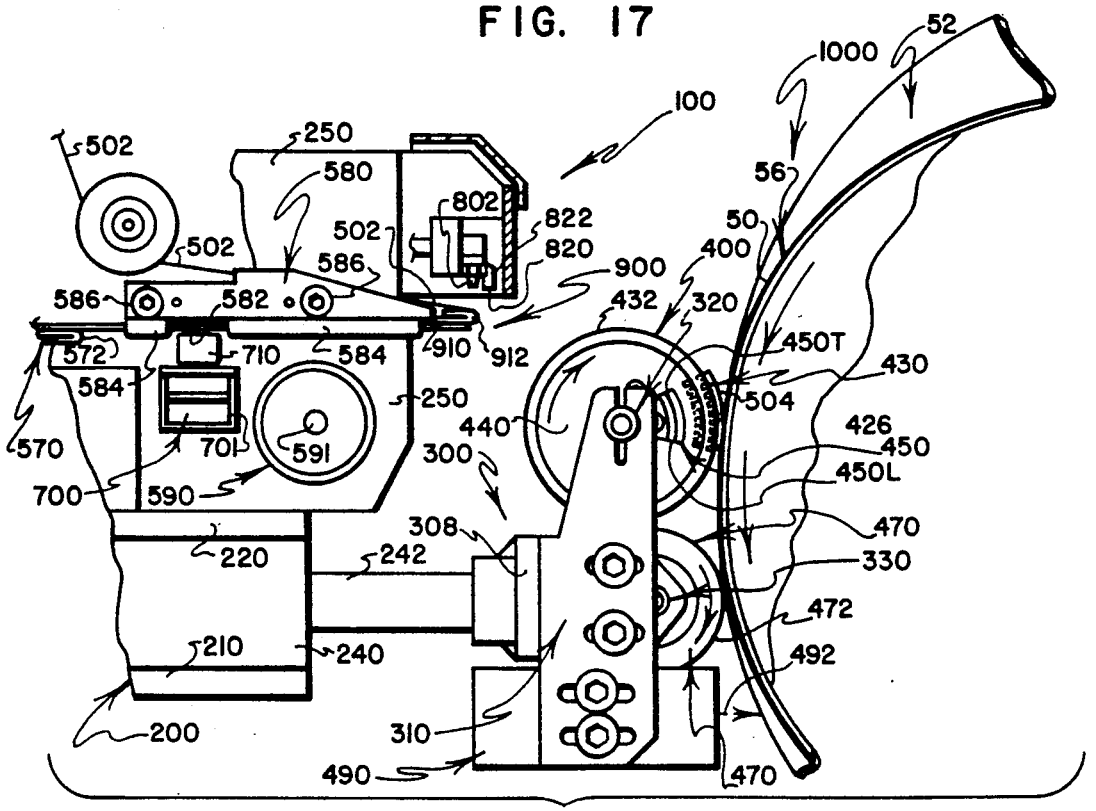
FIG. 18 is a left side elevational view similar to FIG. 17 but showing the application roller and the label it carries rotated clockwise to about a three o'clock position wherein transfer of the label to the tire bead surface has begun.

While a majority of the operating components of the apparatus 100 are connected to and supported by the aforedescribed frame structure 200, some of the operating components of the apparatus 100 are connected to and supported by a carriage 300 that is movable relative to the frame structure 200 in forwardly and rearwardly extending directions of travel between "retracted" and "extended" positions. The "retracted" position of the carriage 300 is depicted in FIGS. 1–3 and 13–16, while the "extended" position of the carriage 300 is depicted in FIGS. 17 and 18. The extension direction of movement of the carriage 300 is indicated by an arrow 69 in FIG. 17. The retraction or withdrawal direction of movement of the carriage 300 relative to the frame structure 200 is indicated by arrows 70 in FIGS. 22 and 25.

Referring to FIGS. 1, 2, 25 and 26, a pair of spaced, parallel extending guide rods 242 extend through and are movably supported by the ball bushing assemblies 240. The ball bushing assemblies 240 are commercially available units that are commonly utilized connect components that are to translate relative to each other and that need to be smoothly movable in a relatively friction free manner with minimal side-to-side play. In the apparatus 100, the ball bushing assemblies 240 are used to mount the guide rods 242 for axial movement relative to the frame structure 200.

Inasmuch as front end regions 244 of the guide rods 242 are rigidly connected by suitable fasteners (not shown) to a transversely extending, bar-like portion 308 of the carriage 300, the ball bushing assemblies 240 cooperate with the guide rods 242 to mount the carriage 300 for smooth linear movement relative to the frame structure 200. Positioning of the carriage 300 relative to the frame structure 200 is controlled by operating the fluid operated cylinder 350 to position the cylinder rod 358, the front end region of which is drivingly connected to the transversely extending portion 308 of the carriage 300 by means of a self-aligning coupler that is indicated by the numeral 362 in FIG. 25.

Figure 4:
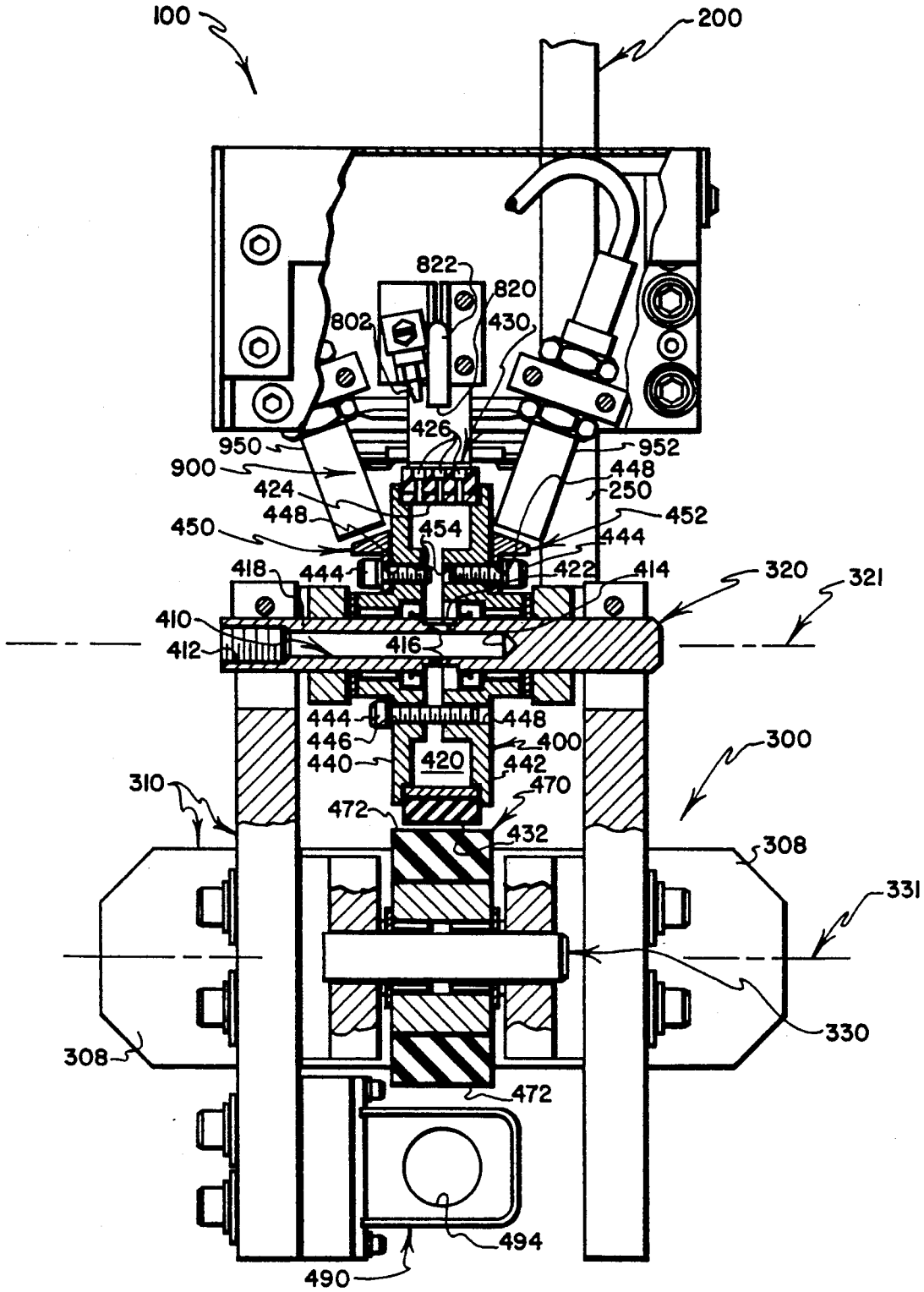
FIG. 4 is a sectional view on an enlarged scale as seen from planes indicated by a broken line 4—4 in FIG. 1.

Referring to FIGS. 1, 2 and 4, the carriage 300 includes spaced sets of mounting bracket formations that are indicated generally by the numeral 310. Referring to FIG. 4, the mounting bracket formations 310 rigidly connect with and support opposite end regions of a pair of shafts 320, 330. The shaft 320 is located above the shaft 330. Both of the shafts 320, 330 extend substantially horizontally and have center axes (not shown) that extend in directions that are transverse to the directions of movement followed by the carriage 300 in extending and retracting relative to the frame structure 200.

A pair of rollers 400, 470 are supported by the shafts 320, 330 for rotation about the spaced parallel axes 321, 331 (see FIG. 4) of the shafts 320, 330, respectively. Also supported by one of the mounting bracket formations 310 is a label reader 490 that has a "window" or "eye" 494 (see FIG. 4) that is aimed along a path that extends beneath the roller 470 along a path that is indicated by an arrow 492 in FIGS. 17 and 18.

The roller 400 will be referred to as the "application roller" inasmuch as it serves the function of initiating the application of the labels 504 one at a time to curved tire bead surfaces 50. The roller 470 is positioned near to but spaced beneath the application roller 400, and will be referred to by the term "resilient roller" 1) inasmuch as it is relatively more resilient than is the application roller 400, and 2) inasmuch as the resilient character of the circumferentially extending surface 472 of the roller 470 is utilized to assist the application roller 400 by completing the application of labels 504 to tire bead surfaces 50 as by resilient deforming so as to conform to the shape of the bead surfaces 50 so that the resilient roller 470 can, in a highly effective manner, firmly press the labels 504 into conforming engagement with the complexly curved bead surfaces 50 that are to receive the labels 504.

Referring to FIG. 4, while the application roller 400, the resilient roller 470 and the label reader 490 have portions thereof that extend in vertical alignment, there nonetheless are spaces between the rollers 400, 470 and between the roller 470 and the reader 490 that permit each of these components to perform its function substantially independent of (and free from being disturbed by) the functioning of the other of these carriage mounted components. In operation, the rollers 400, 470 and the label reader 490 function rapidly in sequence 1) to initiate the application or "affixing" of one of the labels 504 to a curved bead surface 50, 2) to complete the application or "affixing" of the label to the bead surface, and 3) to check for proper completion of the application by effecting a "read" of indicia that is printed on the label.

Figure 14:
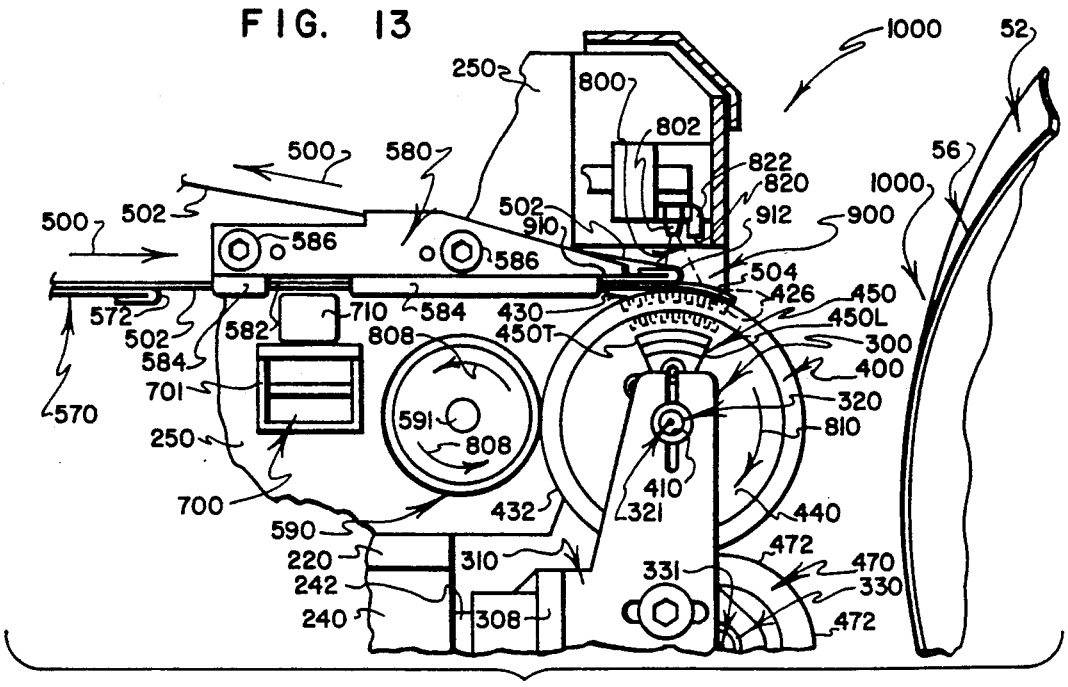
FIG. 14 is a left side elevational view similar to FIG. 13 but on an enlarged scale and showing a label during the process of being peeled from the web and being transferred into engagement with the label-receiving surface portion of the application roller, and with the label and the label-receiving portion assuming about a twelve o'clock position about the circumference of the application roller.

Referring to FIGS. 4 and 14, the shaft 320 that supports the application roller 400 has a vacuum evacuation passage 410 that extends internally within a portion of the shaft 320. The passage 410 has a left end region that is enlarged and provided with threads, as is indicated by the numeral 412 in FIG. 4. A suitable vacuum hose fitting (not shown) preferably is installed in the passage end region 412 for connecting the passage 410 through a vacuum hose (not shown) to a vacuum pump.

Referring to FIG. 4, the passage 410 extends from the left end region 412 to a right end region 414 located within the right half of the length of the shaft 320. At a location that is mid-way along the length of the shaft 320, a plurality of radially extending holes 416 are formed through a tubular wall portion 418 of the shaft 410 that surrounds the passage 410. Each of the holes 416 serves to communicate the passage 410 with a vacuum chamber 420 that is defined within the interior of the application roller 400. The vacuum chamber 420 is annular in configuration, has an inner diameter surface 422 (defined principally by exterior surface portions of the shaft 320), and has an outer diameter surface 424. The holes 416 open through the inner diameter surface 422. Other radially extending holes 426 have inner end regions that open through the outer diameter surface 424 of the chamber 410, and through a short segment 430 of the circumferentially extending outer surface 432 of the application roller 400.

The holes 426 open through the short surface segment 430 in a regular array (typically an array of rows and columns) that causes the holes 426 to be substantially equally spaced along the length of the segment. What the segment 430 (and the rows and columns of holes 426 that open through it) define will be referred to hereinafter as defining a "label-receiving surface 430"—i.e., a specially configured portion of the circumferentially extending surface 432 of the application roller 400. Ambient air is drawn through the holes 426 and evacuated from the chamber 420 through the passage 410 for enabling the application roller 400 to utilize air pressure differential forces to assist in retaining the indicia-carrying front face of a label 504 in firm contact with the label-receiving surface 430.

The label-receiving surface portion that is occupied by the array of holes 426 preferably has a length (as measured along the circumference of the circle that is defined by the outer surface 432) that is selected to be slightly less than the length of one of the labels 504 that is to be dispensed onto the application roller 400 for being transferred by the application roller 400 to the tire bead surface 50. Likewise, the width of the label-receiving surface portion that is occupied by the holes 426 is slightly less than the width of one of the labels 504. This confinement of the location of the array of holes 426 to dimensions that are slightly smaller than those of the labels 504 that are to be dispensed is possible due at least in part to the very accurate positioning that is achieved at the dispensing station of labels 504 onto the label-receiving surface portion 430.

Referring to FIGS. 1, 2 and 4, the application roller 400 has left and right disc-like members 440, 442 that are of annular configuration and define the majority of the side structure of the application roller 400. A plurality of threaded fasteners, one of which is shown in FIG. 4 and is indicated by the numeral 444), extend through holes 446 that are formed at locations spaced about the shaft 320 (one being shown in FIG. 4) and are threaded into aligned holes 448 that are formed in the right disc member 442 (one being shown in FIG. 4) for connecting the disk members 440, 442 and for preventing relative rotation thereof.

At positions that can be described generally as being "within the vicinity" of the label-receiving surface 430, short, arcuate left and right "trigger" members 450, 452 are connected to outer surface portions of the left and right disc members 440, 442, respectively. Threaded fasteners 444 (two of which are shown in FIG. 4) extend through arcuate slots 448 that are formed through the trigger members 450, 452, and thread into underlying holes 454 that are formed in the disc members 440, 442

The arcuate slots 448 (they appear like "holes" in FIG. 4 inasmuch as they are shown in cross-section at their narrowest width in this view, but will be understood to extend in arcs that have as their center of radius the axis of the shaft 320) permit the angular adjustments of the left and right trigger members 450, 452 relative to the positions of their associated left and right disk-like members 440, 442 (and relative to the label-receiving surface 430 of the application roller 400). By this arrangement, the angular positions of leading and trailing edge portions 450L, 450T (see FIG. 1) and 452L, 452T (see FIG. 2) of the left and right trigger members 450, 452 can be sensed to provide meaningful information regarding the angular position of the application roller 400 (and, more specifically about the angular position of the label-receiving surface 430 of the application roller 400).

Among the frame-structure-supported operating components are left and right proximity sensors 950, 952 that (as is best seen in FIG. 4) depend into close proximity with the left and right trigger members 450, 452 when the application roller 400 is situated at what will be referred to as a "label dispensing station 900" (see FIGS. 13–16). Because, when the application roller 400 is situated at the dispensing station 900, proper operation of the apparatus 100 necessitates that the label-receiving surface 430 be properly positioned if it is to receive and transport a freshly dispensed label 504; thus, the angular position-sensing capability that is provided by the left and right proximity sensors 950, 952 working in conjunction with the left and right trigger members 450, 452 is of importance.

Returning now to a discussion of operating components that are carried by the frame structure 200, by noting the significant differences in what is shown in the left side view that comprises FIG. 1 and right side view that comprises FIG. 2, it will be observed that very different types of operating components tend to be provided on the left and right sides of the main plate 250. The left side components shown in FIG. 1 primarily tend to be associated with the feeding of the carrier web 502 to and through the dispensing station 900. The right side components shown in FIG. 2 primarily tend to be associated with transmitting rotational energy among an array of shaft-supported and spindle-supported sprockets.

Beginning with what is depicted in FIG. 1, it will be seen that many of the left side components cooperate to define a path of travel (indicated by a series of arrows 500) for moving the carrier web 502 from a "supply station" that is defined by a supply reel 510 through the dispensing station 900 to a "collection station" that is defined by a collection reel 520. As will be explained in greater detail, at the dispensing station 900, the carrier web 502 is reeved around a blunt-nosed formation 912 of a "peel bar" 910 to effect the kind of reverse bend that is depicted in FIG. 20 to "peel" labels 504 from the carrier web 502. After the carrier web 502 is tightly reversely bent at the dispensing station 900, "spent"

carrier web material 502 is tensioned and fed to the collection reel 520.

In directing the carrier web 502 from the supply reel 520 to and through the dispensing station 900 to the collection reel 520, a series of main-plate-mounted components are utilized. These components include a first pair of flanged guide rollers 530, a second set of flanged guide rollers 540, a first capstan 550, a pinch roller assembly 560, and a pair of guide structures 570, 580—with the guide structure 580 also serving to define the aforementioned peel bar 910 and blunt-nosed formation 912.

Figure 11:
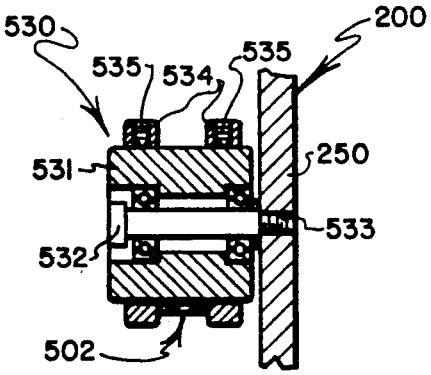

Inasmuch as the flanged guide rollers 530 are identical one to the other and are identically mounted on the main plate 250, only one of the flanged guide rollers 530 is depicted in the drawings (see FIG. 11). Inasmuch as the flanged guide rollers 540 are identical one to the other and are identically mounted on the main plate 250, only one of the flanged guide rollers 540 is depicted in the drawings (see FIG. 12).

Figure 5:
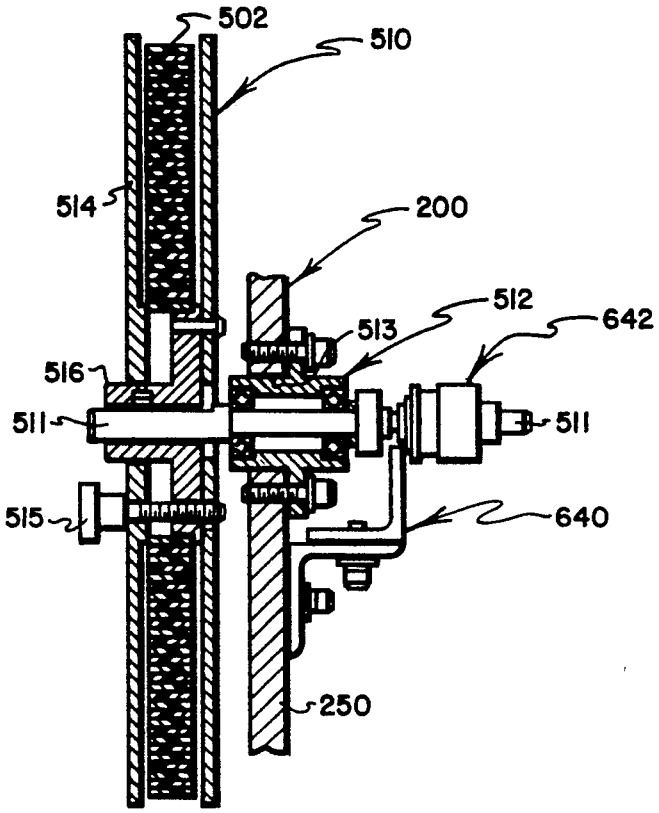
FIGS. 5, 6 and 7 are sectional views on an enlarged scale as seen from planes indicated by lines 5—5, 6—6 and 7—7 in FIG. 1, respectively.

Referring to FIG. 5, the supply reel 510 is mounted on the left end region of a spindle 511. The spindle 511 is journaled by a bearing block assembly 512 that is installed in an opening 513 that is formed through the main plate 250. A drag brake assembly 642 (i.e., a commercially available mechanical assembly that functions to slightly inhibit the rotation of the spindle 511 so as to permit the unreeling of the label-carrying web 502 from the supply reel 510 only in the event that a suitable degree of tension is applied to the web 502) is installed on the right end region of the spindle 511. The drag brake 642 engages a bracket assembly 640 that is mounted on the right side of the main plate 250. The engagement of the drag brake 642 with the bracket assembly 640 occurs as a standard part of the operation of the drag brake 642 in serving to slightly inhibit the rotation of the spindle 511.

Referring to FIG. 1, a feature of the supply reel 510 is that it has a disc-like front face 514 that normally is held in place by a pair of knurled thumb screws 515 (only one of which is shown in FIG. 5, but both of which are shown in FIG. 1). When the thumb screws 515 are loosened, the front face 514 of the reel 510 can be rotated slightly in a counterclockwise direction to align the relatively large head portions of the thumbscrews 515 with even larger holes 515*a* that are formed through the front face 514, whereupon the front face 514 can be removed from the hub 516 of the reel 510 to permit the supply of label-carrying web material 502 to be replenished.

Figure 7:
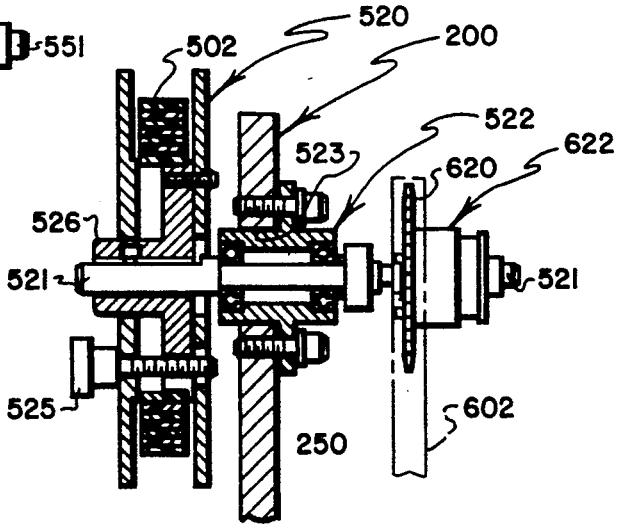

Referring to FIG. 7, the collection reel 520 is mounted on the left end region of a spindle 521. The spindle 521 is journaled by a bearing block assembly 522 that is installed in an opening 523 that is formed through the main plate 250. A slip clutch assembly 622 (i.e., a commercially available mechanical assembly that functions to permit slippage to take place between a drive sprocket 620 that is driven by the roller chain 602 and the spindle 521 so as to permit the reeling of spent web material 502 onto the collection reel 520 at a pace that corresponds to the pace at which spent web material 502 is made available to the collection reel 520) is installed on the right end region of the spindle 521.

Referring to FIG. 1, a feature of the collection reel 520 is that it has a disc-like front face 524 that normally is held in place by a pair of knurled thumb screws 525 (only one of which is shown in FIG. 7, but both of which are shown in FIG. 1). When the thumb screws 525 are loosened, the front face 524 of the reel 520 can be rotated slightly in a counterclockwise direction to align the relatively large head portions of the thumbscrews 525 with even larger holes 525*a* that are formed through the front face 524, whereupon the front face 524 can be removed from the hub 526 of the reel 520 to permit the rolled-up collection of spent web material 502 to be discarded.

Figure 6:
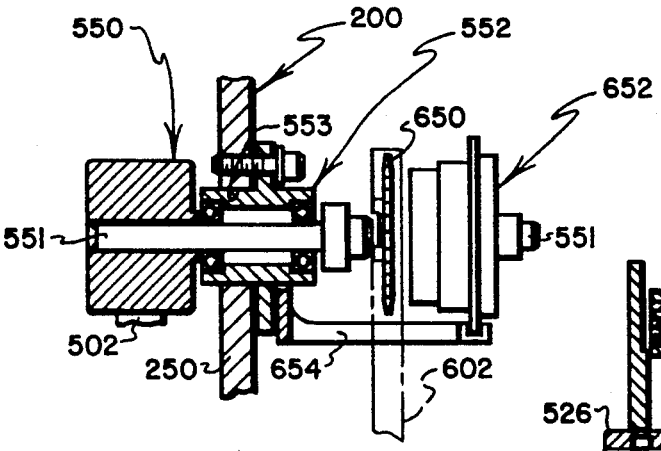

Referring to FIG. 6, a first capstan 550 is mounted on the left end region of a spindle 551. The spindle 551 is journaled by a bearing block assembly 552 that is installed in an opening 553 that is formed through the main plate 250. An electrically operated clutch and brake assembly 652 (i.e., a commercially available electro-mechanical assembly that functions to selectively drivingly interconnect and disconnect a drive sprocket 650 that is driven by the roller chain 602 with the spindle 551 so as to permit the first capstan 550 to be driven only when it is desired to do so, with the unit including a brake to bring the spindle 551 to a prompt halt in the event that the clutch disengages) is mounted on the right end region of the spindle 551 and is positioned to engage a brake stop bracket 654 that is mounted on the right side of the main plate 250.

Referring to FIG. 1, a second capstan 590 that is identical in all respects to the first capstan 550 is mounted on the left end region of a spindle 591 at a location where the capstan 590 will drivingly engage the application roller 400 when the carriage 300 positions the application roller 400 in the dispensing station 900. The bearing block assembly that supports the spindle 591 (and other aspects of the second capstan 590 that would be illustrated if the sectional view of FIG. 6 were duplicated) is not shown in the drawings. However, referring to FIG. 2, portions of an electro-magnetic clutch brake assembly 692 that functions to selectively drivingly interconnect and disconnect a drive sprocket 690 (that is driven by the roller chain 602) from the spindle 591 are shown.

Referring to FIG. 11, the flanged guide roller 530 includes a generally cylindrically roller 531 that is bearing-mounted on a shoulder bolt 532 for rotation relative thereto. The shoulder bolt 532 is threaded into a hole 533 that is formed through the main plate 250. A pair of collars 534 extend in spaced relationship about the periphery of the cylindrical roller 531 and are held in place by set screws 535 to serve as raised, spaced flanges that define a web guide channel therebetween.

Figure 12:
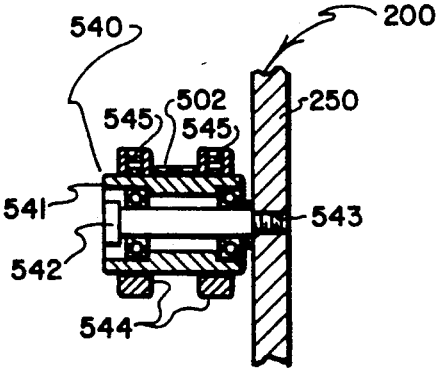

Referring to FIG. 12, the flanged guide roller 540 includes a generally cylindrically roller 541 that is bearing-mounted on a shoulder bolt 542 for rotation relative thereto. The shoulder bolt 542 is threaded into a hole 543 that is formed through the main plate 250. A pair of collars 544 extend in spaced relationship about the periphery of the cylindrical roller 541 and are held in place by set screws 545 to serve as raised, spaced flanges that define a web guide channel therebetween.

Figure 8:
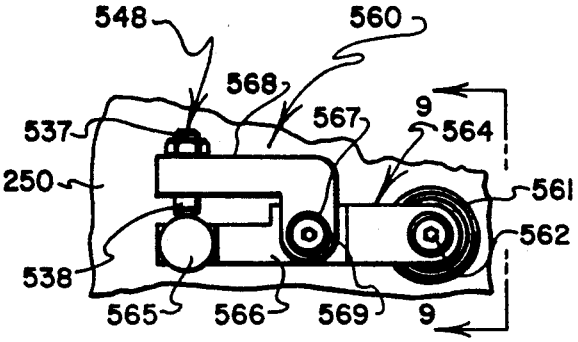
FIG. 8 is an enlargement of selected portions of the left side elevational view of FIG. 1, with the view principally depicting portions of a pinch roller assembly.
Figure 9:
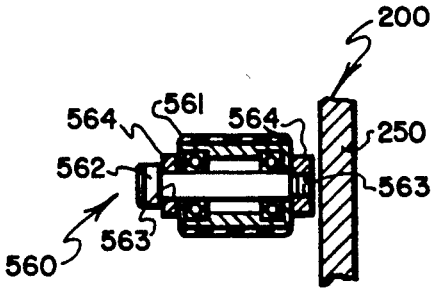
FIG. 9 is a sectional view as seen from a plane indicated by a line 9—9 in FIG. 8.
Figure 10:
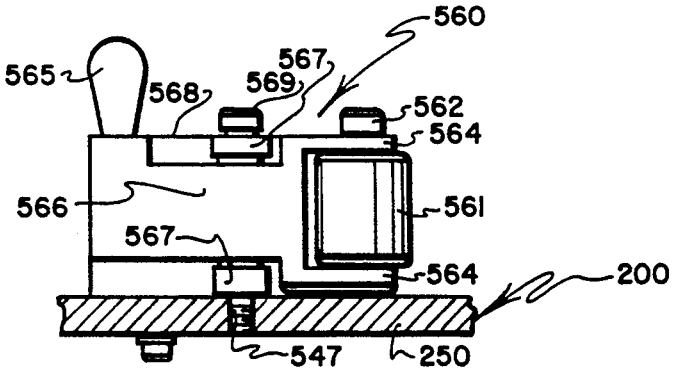
FIGS. 10, 11 and 12 are sectional views as seen from planes indicated by lines 10—10, 11—11 and 12—12 in FIG. 1, respectively.

Referring to FIGS. 8–10, the pinch roller assembly 560 includes a pinch roller 561 that is bearing mounted on a cap screw 562. The cap screw 562 extends through aligned holes 563 that are formed in spaced parts of a yoke arm 564. The yoke arm 564 extends substantially horizontally from a right end region where the roller 561 is mounted, to a left end region that mounts an operator-engageable knob 565. A mid portion 566 of the yoke arm 564 extends between spaced projections 567 that are formed on an L-shaped bracket 568. A cap screw 569 is threaded through aligned holes (not shown) that are formed through the projections 567 and through the mid portion 566, and is threaded into a hole 547 that is formed in the main plate 250. A spring plunger assembly 548 ((i.e., a commercially available assembly that has a threaded outer housing portion 537 that is insertable into a threaded hole (not shown) that is formed through the left end region of the L-shaped bracket 568, and that carries a spring (not shown) for biasing a depending plunger 538 downwardly into engagement with the left end region of the yoke arm 564 to thereby bias the right end region of the yoke arm 564 upwardly)) is carried by the L-shaped bracket 568 and tends to bias the roller 561 toward engagement with the capstan 550 (see FIG. 1).

Referring to FIG. 1, the guides 570, 580 are arranged in series and in-line one with another to align a substantial length of label-carrying web material 502 for feeding horizontally forwardly from the forwardmost one of the flanged guide rollers 530 to the dispensing station 900. The guide 570 is several inches in length, has rounded end regions 572, underlies a significant portion of the travel path 500 that is followed by the web 502, and is connected to the right side of the main plate 250 by fasteners 574. The forwardmost one of the flanged guide rollers 530 directs the label-carrying web 502 straight along a top surface 576 of the guide 570 (i.e., the top surface 576 of the guide 570 extends in a horizontal plane that substantially tangentially intercepts the bottom surface of the roller 531 of the forwardmost one of the flanged guide rollers 530).

Whereas the guide 570 underlies the label-carrying web 502, the guide 580 overlies the label-carrying web 502 by providing a downwardly facing, horizontally extending guide surface 582. While the guide 570 does little, if anything, to assist in maintaining the travel path 500 that is followed by the label-carrying web 502 parallel to the main plate 250, the guide 580 has depending guide portions 584 that assist in assuring that, as the label-carrying web 502 enters the dispensing station 900, the travel path 500 that is followed by the web 502 is desirably spaced from and extends parallel to the main plate 250.

Positioned beneath the downwardly facing guide surface 582 relatively near to the rear end region thereof is a fluid operated cylinder assembly 700. The cylinder assembly 700 has a housing 701 that is secured by suitable fasteners (not shown) to the main plate 250, and has an upwardly extensible ram 702 (see FIG. 15) that carries a resilient "bumper" 710. Normally, the ram 702 is not extended and the resilient bumper 710 is positioned by the ram 702 at a distance spaced sufficiently below the guide surface 582 so that the bumper 710 makes no contact with the label-carrying web 502 that is being fed to the dispensing station 900. However, when the cylinder assembly 700 is operated to extend the ram 702, the label-carrying web 502 is firmly clamped between the guide surface 582 and the resilient bumper 710.

Figure 13:
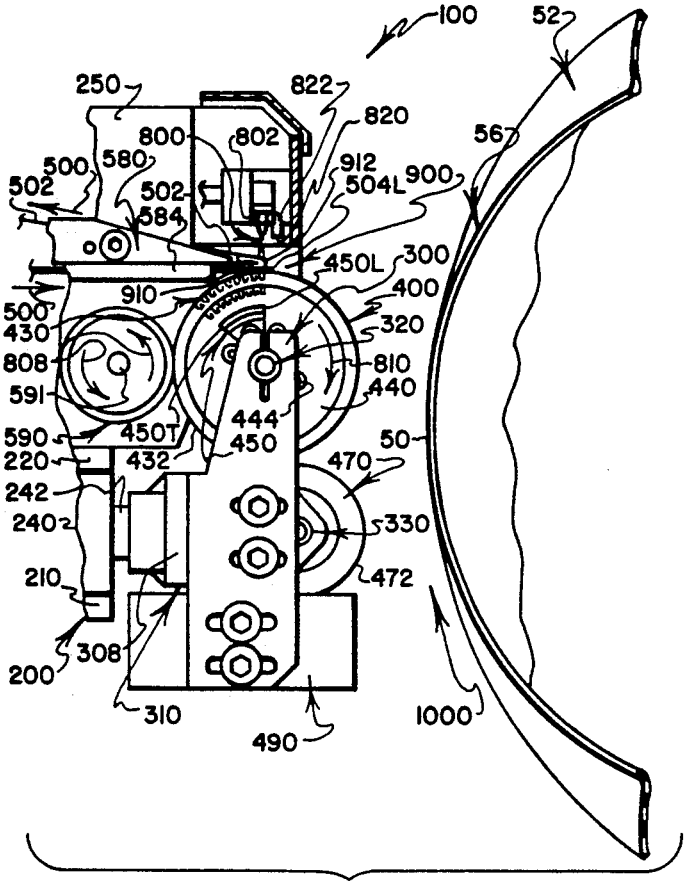
FIG. 13 is an enlargement of selected portions of the left side elevational view of FIG. 1 showing features of a label dispensing station with an application roller positioned therein and having a label-receiving surface portion thereof oriented at about an eleven o'clock position to rotate clockwise beneath a label as the label is peeled from the carrier web at the dispensing station.

Referring to FIGS. 13–18, the guide 580 is connected by fasteners 586 to the main plate 250, and has its blunt-nosed forward end 912 positioned substantially centrally within what is referred to as the "dispensing station 900." Referring to FIG. 13, the process of dispensing a label 504 at the dispensing station 900 typically begins with a tiny leading edge portion 504L of an about-to-be-dispensed label 504 already having been slightly separated from the reversely turned web 502 that is reeved around the blunt end region 912 of the guide 580.

In preferred practice, each "dispensing operation" (i.e., each new encounter of a label 504 with the application roller 400) is begun by bringing the leading edge 504L of each new label 504 to a predetermined, precisely detected position. For this purpose, a viewing window 820 (i.e., the end of a fiber optic cable 822 that connects with an optical detection system, as will be explained later herein) is positioned above and slightly forwardly with respect to the blunt-nosed end formation 912 about which the carrier web is reversely turned in order to effect "peeling" of the labels 504 from the web 502. The downwardly facing window 820 is centered over the application roller 400 and "looks" for the contrast that is provided by the leading edge of a typically white label 504 which is moving along the typically black background of the circumferentially extending surface 432 of the application roller 400.

By starting each dispensing operation with a label 504 positioned precisely at the same "known" location, one knows precisely how much rotation of the application roller 400 is required to move to a position where full separation of the label 504 from the web 502 and from a next-to-be-fed label will take place. Likewise, by knowing the position of the leading edge of a label 504 that is engaged by the label-receiving surface 430, and by knowing the length of the label 504, the extent to which the application roller 400 must rotate clockwise before a next-to-be-dispensed label will have its leading edge positioned adjacent the blunt-nosed formation 912 is automatically determined so that it is known precisely when to terminate the feeding of the web 502 and when to clamp the label-carrying web 502 between the bumper 710 and the guide surface 582 (i.e., it is known quite precisely when label "separation" from the carrier web 502 and from a next-to-be-dispensed label will be effected).

Just as the proper positioning of a leading edge 504L of a next-to-be-dispensed label 504 is a "prerequisite" to dispensing of the label 504, so is the proper positioning of the label-receiving surface 430 of the application roller 400. To assure that proper positioning of the application roller 400 is achieved, one or both of the proximity sensors 950, 952 are utilized to sense the position of leading edge portions 450L, 452L of the trigger members 450, 452; and, once the application roller 400 has been rotated to properly position the label receiving surface 430 (as is depicted in FIG. 13), one or both of the sensors 950, 952 provides a signal of readiness for label dispensing to proceed.

As a dispensing operation is begun, a jet of air (indicated by the numeral 800 in FIG. 13) is discharged from a nozzle 802 that is located above the blunt-nosed formation 912; and, the capstan 590 begins to rotate in a counterclockwise direction (indicated by the arrows 808) to rotate the application roller 400 in a clockwise direction (indicated by an arrow 810) to move the label-receiving surface 430 into position directly under a label 504 that is being peeled from its backing web 502.

Referring to FIG. 14, as dispensing of the label 504 proceeds, the effect of the jet of air 800 combined with the effect of ambient air being drawn through the holes 426 that are formed in the label-receiving surface 430 conforms the label 504 to the curved shape of the label-receiving surface 430; and, as the dispensing of the label 504 continues, the grip that is provided by air pressure differential forces acting on the label 504 is adequately secure to enable continued clockwise rotation of the application roller 400 to pull the label 504 free from the web 502 and free from the next-to-be-dispensed label.

Figure 15:
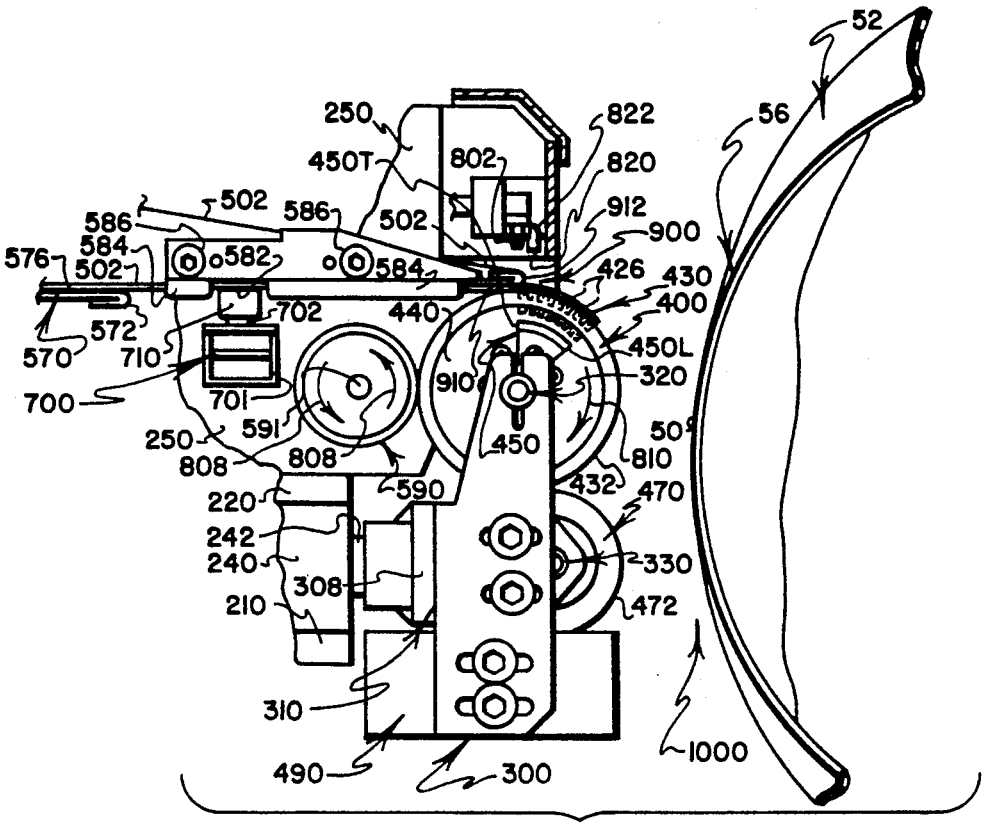
FIG. 15 is a left side elevational view similar to FIG. 13 but showing the label substantially fully peeled from the web and engaging the label-receiving surface portion of the application roller, with the label and the label-receiving surface rotated clockwise to about a one o'clock position, and with a fluid operated cylinder actuated to cause a resilient "bumper" to clamp a label-carrying portion of the web against a guide surface to terminate feeding of label-carrying portions of the web toward the dispensing station.
Figure 16:
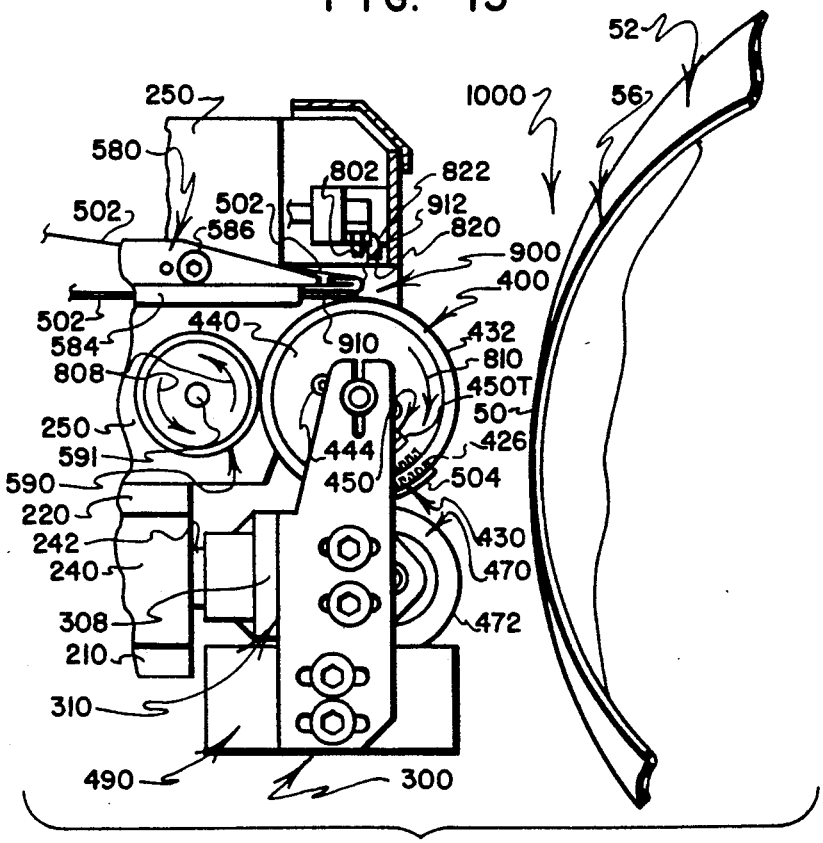
FIG. 16 is a left side elevational view similar to FIG. 15 but showing the label and the label-receiving portion of the application roller rotated clockwise to about a five o'clock position.

Referring to FIG. 15, once "separation" of a newly dispensed label 504 has been achieved (at which moment the label-receiving surface 430 of the application roller 400 is oriented at about the one o'clock position that is shown in FIG. 15), smooth, continued operation of the capstan 590 is maintained until, as is shown in FIG. 16, the label is at about a five o'clock position.

Referring to FIG. 17, when the carriage 300 is translated to move the application roller 400 out of the dispensing station 900 and into the application station 1000, the label 504 that is carried by the application roller 400 preferably is at about a five o'clock position so that even its trailing edge is assured of not touching the rotating bead surface 50 that is drivingly engaged by the application roller 400 when it enters the application station 1000. By so positioning the label 504, the application roller 400 has at least about ¾ of a revolution during which to "get up to speed" with the velocity of the bead surface 50 so that, when the label 504 initially is affixed to the bead surface 50 by the action of the relatively hard application roller 400 pressing the label 504 against a portion of the curved bead surface 50, it will be assured that the speed at which the label 504 is moving substantially matches the speed of the bead surface 50.

Referring to FIG. 18, once the label 504 has been preliminarily affixed to the bead surface 50 by the application roller 400, it travels with the bead surface 50 and quickly is engaged by the resilient roller 470. In preferred practice, the position of the resilient roller 470 relative to the structure of the carriage 300 that mounts the roller 470 is adjusted to enable the peripheral surface 472 of the roller 470 to "deform" adequately to assure that, when the roller 470 travels across the label 504, the roller will securely press the label 504 into conforming engagement with the curved bead surface 50.

Another leftwardly projecting main-plate-mounted operating component is a drive motor 610. The motor 610 has an output shaft (not shown) that extends through a hole (not shown) that is formed through the main plate 250 for connection with a right-side-mounted gear reducer unit that is indicated in FIG. 2 by the numeral 612.

Referring to FIG. 2, many of the operating components that are positioned on the right side of the upstanding main plate 250 cooperate to suitably drive operating components that are positioned on the left side of the upstanding main plate 250. For example, a number of the right-side operating components carry roller chain sprockets that are drivingly interconnected by a roller chain 602 that moves along a path of travel that is indicated generally by arrows 600. The sprockets 650 and 690 are connected by the clutches 652, 692 for selectively transferring rotary motion to the spindles 651, 691 that drivingly connect with the first and second capstans 550, 590, respectively. Similarly, the sprocket 620 connects with the slip clutch 622 that transfers rotary motion to the spindle 621 to rotate the collection reel 520.

The sprocket 614 connects with an output shaft 616 of the gear reducer unit 612 to effect movement of the chain 602 along the travel path 600 when the motor 610 is operated. A main-plate-mounted tensioner assembly 630 carries a sprocket 632 that engages the roller chain 602 to maintain proper chain tension.

Another right-side main-plate-mounted component is an optical detector unit 850 that is capable of "viewing" through a "window" that is located remotely, namely a window that is defined by a fiber optic cable connects with the unit 850. A Y-type cable 852 extends from "input" and "output" ports 854, 856 of the unit 850 to permit the unit 850 to output light from a light emitting diode (not shown) through the fiber optic cable 852 to illuminate the remote viewing area, and to input information regarding changes that are noted in monitoring the remote viewing area. The unit 850 and its cable 852 are commercially available from a variety of sources. The remote viewing area monitored by the unit 850 is defined by the aforedescribed fiber optic cable end 820 that is positioned atop the label dispensing station 900.

Still another right-side-mounted component is a guard 880 that extends about (so as to protectively enclose) the right-side drive system components, including the roller chain 602 and the various sprockets 614, 620, 632, 650 and 690 that are drivingly connected by the roller chain 602). Brackets 882 and associated fasteners 884 are used to mount the guard 880 on the right side of the main plate 250.

At a number of locations on the tire labeling apparatus, what are commonly referred to as "proximity sensors" are used to detect the presence or absence from particular locations of relatively movable components. Referring to FIG. 4, for example, left and right proximity sensors 950, 952 that are positioned to relatively closely overlie the left and right trigger members 450, 452 that are carried by left and right side portions of the application roller 400. By adjusting the positions of the trigger members 450, 452 so that passage by the sensors 950, 952 of the leading and/or trailing edges of the trigger members will cause the generation of signals, the capstan 590 can be switched into and out of operation to adjust the rotary position of the application roller 400.

While label "decoders" (e.g., bar code detector and reader units) of the type indicated generally by the numeral 490 are available from a variety of sources, a rapidly operating unit that has been found to exhibit reliable operation is sold by Skan-A-Matic Corp. of Elbridge, N.Y. 13060 under the model designations S-25 (for a fixed beam scanner) and D-2 (for a bar code reader).

Operation of the tire labeling apparatus 100 preferably is carried out in accordance with the relatively lengthy operational summary that is provided earlier herein, namely toward the close of the section that summarizes features of the preferred practice of the invention. However, as those who are skilled in the art readily will understand, the present invention provides a plurality of combinations of features that are believed to be patentable, as is evidenced by the claims that follow.

Although the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. Label application apparatus for transferring labels one at a time from a dispensing station to an application station, and for applying labels to surfaces of rotating articles at the application station, comprising:

a) an application roller having a peripheral surface that extends substantially concentrically about a center axis;

b) carriage means including carriage structure connected to the application roller for supporting the application roller for rotation about its center axis;

c) frame means including frame structure connected to the carriage structure for supporting the carriage structure for translational movement relative to the frame structure for moving the application roller along a substantially linear travel path between a dispensing station wherein the peripheral surface of the application roller is positioned to receive labels that are delivered one at a time to the dispensing station, and an application station wherein the peripheral surface of said roller is positioned to transfer labels one at a time to surfaces of rotating articles, with the application station and the dispensing station being spaced from one another along the substantially linear travel path such that translational movement of the application roller along the substantially linear travel path is required in order to move the application roller from the dispensing station to the application station, and from the application station to the dispensing station;

d) label dispensing means connected to the frame means for delivering one label at a time to the dispensing station, e) means for effecting said application roller translational movement, f) power means for drivingly engaging the application roller when the application roller is positioned in the dispensing station for effecting rotation of the application roller to rotatably angularly position the peripheral surface thereof so that labels are received on a substantially predetermined label-receiving surface segment of the roller surface; and, g) first cooperating sensor means on said frame means and said roller for detecting when rotation of the application roller has angularly positioned the label-receiving surface segment for reception of a label thereon prior to said movement of said application roller from the dispensing station, the said means for detecting by said cooperating sensor means effecting transfer of a said label from the said application station to the said label-receiving surface segment of said application roller.

2. The apparatus of claim 1 wherein said movement effecting means includes power operated means connected to the frame structure and to the carriage structure for effecting said relative translational movement between the frame structure and the carriage structure in directions extending along the substantially linear travel path for moving the application roller in one of said directions from the dispensing station to the application station, and for moving the application roller in an opposite of said directions from the application station to the dispensing station.

3. The apparatus of claim 2 wherein the power operated means includes a fluid-operated cylinder having a housing and a cylinder rod that is supported by the housing for translation movement relative thereto in said one and opposite directions between extended and retracted positions, with a selected one of the housing and the cylinder rod being connected to the frame structure, and with the other of the housing and the cylinder rod being connected to the carriage structure for effecting said relative translation movement between the frame structure and the carriage structure.

4. The apparatus of claim 1 wherein the power operated means includes first power driven capstan means for defining a first generally cylindrical drive surface 1) that is rotatable about a first capstan axis that extends substantially parallel to the central axis of the application roller when the application roller is positioned along the substantially linear travel path in the dispensing station, and 2) that drivingly engages the peripheral surface of the application roller when the application roller is positioned along the substantially linear travel path in the dispensing station.

5. The apparatus of claim 1 wherein:

a) the label dispensing means delivers labels one at a time to the dispensing station by feeding to and through the dispensing station a length of carrier web, with carrier web portions that are fed to the dispensing station carrying a plurality of the labels arranged one after the other along the length thereof; and, b) the label dispensing means includes power operated means for effecting said feeding of the carrier webs.

6. The apparatus of claim 5 wherein the power operated means for effecting carrier web feeding includes second power driven capstan means for defining a second generally cylindrical capstan drive surface 1) that is rotatable about a second capstan axis, and 2) that drivingly engages the carrier web for effecting said feeding of the carrier web to and through the dispensing station in response to rotation of the second capstan drive surface about the second capstan axis.

7. The apparatus of claim 6 additionally including sensing means for detecting when feeding of the carrier web has effected positioning of a web-carried label in a predetermined location at the dispensing station where a label desirably is positioned to begin delivering the label onto a predetermined portion of the peripheral surface of the application roller.

8. The apparatus of claim 1 additionally including:

a) first power driven capstan means connected to the frame structure for defining a first generally cylindrical drive surface 1) that is rotatable about a first capstan axis that extends substantially parallel to the central axis of the application roller when the application roller is positioned in the dispensing station, and 2) that drivingly engages the peripheral surface of the application roller when the application roller is positioned in the dispensing station for effecting rotation of the application roller about its center axis relative to the frame structure to angularly position the peripheral surface of the application roller;

b) guide means connected to the frame structure for directing the feeding of labels one at a time to the dispensing station as by guiding a length of carrier web along a predetermined feed path to and through the dispensing station, with carrier web portions that are fed to the dispensing station being provided with a plurality of labels arranged one after the other along the length of such carrier web portions;

c) second power driven capstan means connected to the frame structure for defining a second generally cylindrical drive surface 1) that is rotatable about a second capstan axis, and 2) that drivingly engages the carrier web for effecting said feeding of the carrier web to and through the dispensing station in response to rotation of the second capstan drive surface about the second capstan axis;

d) second sensor means for detecting when feeding of the carrier web has positioned a web-carried label in a predetermined location at the dispensing station where a label desirably is positioned at the initiation of a label transfer process; and, e) said first and second generally cylindrical drive surfaces are of substantially equal diameter and are driven at substantially identical rotary speeds whereby, once the first and second sensor means have sensed 1) that the label-receiving surface segment is positioned at said predetermined angular position, and 2) that a web-carried label is positioned at said predetermined location at the dispensing station, a label transfer process can be initiated as by concurrently operating the first and second power driven capstan means to concurrently rotate the first and second generally cylindrical drive surfaces to cause the speed at which said label is moved by the web to substantially match the speed of surface movement of the label-receiving surface segment to thereby facilitate the transferring of said label from the carrier web to the label-receiving surface segment of the application roller.

9. The apparatus of claim 8, wherein:

a) the guide means includes formation means for defining a blunt-nosed end formation that is located at the dispensing station; and, b) the guide means defines an elongate guide surface that is configured to extend along one side of such label-carrying portions of the carrier web as are approaching the dispensing station, with the guide surface assisting to orient such label-carrying web portions to extend within a plane that passes through a space that is provided between blunt-nosed end formation and the peripheral surface of the application roller when the application roller is position at the dispensing station.

10. The apparatus of claim 9 additionally including power-operated means connected to the frame structure and being positioned within relatively close proximity to said elongate guide surface for being selectively actuated to clamp a label-carrying portion of the carrier web into firm engagement with the elongate guide surface to selectively inhibit feeding of the web to and through the dispensing station.

11. The apparatus of claim 10 wherein the web-clamping power-operated means includes:

a) housing means for being connected to the frame structure;

b) operator means for being moved relative to the housing means when the power-operated means is actuated, with the direction of movement operator means when actuated being generally toward the elongate guide surface; and, c) resilient bumper means connected to and carried by the operator means for being brought into engagement with label-carrying portions of the web to clamp such web portions against the elongate guide surface when the power-operated means is actuated. and for withdrawing from engagement with the web when the power-operated means is not actuated.

12. The apparatus of claim 8 additionally including means connected to the frame structure and being positioned near the dispensing station for directing a jet of air against a label that is being transferred from the carrier web to the label-receiving surface segment at the dispensing station for aiding in bringing portions of the transferring label into contact with the label-receiving surface segment, and for aiding in conforming the shape of the label to that of the label-receiving surface segment.

13. The apparatus of claim 1 additionally including:

a) guide means connected to the frame structure for directing the feeding of labels one at a time to the dispensing station as by guiding a length of carrier web along a predetermined feed path to and through the dispensing station, with carrier web portions that are fed to the dispensing station being provided with a plurality of labels arranged one after the other along the length of such carrier web portions for being dispensed one at a time at the dispensing station;

b) first sensor means connected to the frame structure for monitoring the positioning of the leading edge of a next-to-be-dispensed label at the dispensing station so as to detect when a next-to-be-dispensed label has reached a predetermined position wherein feeding of the web should be halted until the next-to-be-dispensed label is to be dispensed; and, c) power operated means for feeding the web along said predetermined feed path and for positioning the leading edge of a next-to-be-dispensed label at said predetermined position by utilizing sensed positioning information that is provided by the first sensor means.

14. The apparatus of claim 1 wherein:

a) the application roller is a wheel-like member having opposed, disc-like side components that are interconnected by structure that defines the peripheral surface of the application roller; and, b) said first cooperating sensor means includes at least one proximity sensor that is positioned to detect the proximate presence of at least one formation that is carried on at least one of the disc-like side components.

15. The apparatus of claim 8 wherein the carriage means includes a shaft that extends substantially concentrically along the center axis of the application roller, the application roller is supported by the shaft for rotation about the center axis, the shaft has a hollow interior portion that extends along the center axis, the shaft has passage means that extends substantially radially relative to the center axis for communicating the hollow interior portion of the shaft with a surrounding, substantially annular hollow interior portion of the application roller, and a plurality of holes communicate with the hollow interior portion of the application roller and open through the label-receiving surface segment for ducting ambient air therethrough and into the hollow interiors of the application roller and the shaft for evacuation therefrom so that differential air pressure forces are utilized to retain a label on the label-receiving surface segment as the application roller moves from the dispensing station to the application station.

16. The apparatus of claim 1 wherein the label dispensing means includes web feeding means 1) for defining a web feed path having a first segment that extends from a supply station to a dispensing station, and having a second segment that extends from the dispensing station to a collection station, 2) for effecting a controlled feeding of a length of carrier web along the first segment of the web feed path from the supply station to the dispensing station, 3) for utilizing the carrier web as a transfer medium during feeding thereof along the first segment to deliver from the supply station to the dispensing station a sequence of labels that are removably adhered to the carrier web, 4) for sequentially positioning a leading edge of each such label at a predetermined position at the dispensing station, 5) for defining a blunt-nosed structure located at the dispensing station at the junctures of the first and second segments of the feed path, 6) for feeding portions of the carrier web tightly around the blunt-nosed structure to assist in removing labels one-at-a-time from the carrier web at the dispensing station so that transfers can be effected at the dispensing station of labels from the web to the application roller, and 7) for feeding non-label-carrying portions of the web along the second segment of the feed path from the dispensing station to the collection station.

17. The apparatus of claim 1 wherein:

a) the frame structure includes central mounting plate portions thereof that extend within an imaginary central plane, and base plate portions that are rigidly connected to the central mounting plate portions and that extend transversely relative to the central plane;

b) the frame means includes guide rod means for movably interconnecting the frame structure and the carriage structure, with the guide rod means including a pair of elongate, substantially straight guide rods that extend substantially parallel to each other and to the imaginary central plane, and that extend in an imaginary guide rod plane that extends substantially parallel to the base plate portions, and including bearing means having passages formed therethrough for translatably receiving portions of the guide rod means, with each of the guide rods having a portion of its length received in a separate one of said passages, with each of the guide rods having an end region that is rigidly connected to the carriage structure, and with the bearing means being connected to the base plate portions of the frame structure, whereby the carriage structure is mounted on the frame structure for translation relative thereto along a path of travel that parallels the axes of the guide rods.

18. The apparatus of claim 17 wherein the base plate portions include a pair of substantially flat, parallel-extending base plates that are rigidly connected to opposed faces of the bearing means so as to be held in spaced, parallel relationship, and fluid-operated cylinder means is connected to at least a selected one of the base plates and to the carriage structure for moving the carriage structure relative to the frame structure along said path of travel in response to operation of the fluid-operated cylinder.

19. The apparatus of claim 18 additionally including means for adjustably mounting the label application apparatus on a supporting structure, including a plurality of alignable openings formed through a selected one of the base plates and through an adjacent portion of the supporting structure, and fastener means for insertion into selected aligned ones of the alignable openings to connect the selected base plate to the supporting structure.

20. The apparatus of claim 1 wherein:

a) the frame structure includes a central mounting plate that extends within an imaginary central plane and has first and second opposed side portions thereof;

b) a plurality of openings are formed through the central mounting plate, bearing means are connected to the central mounting plate adjacent selected ones of the openings for rotatably mounting spindles that extend through said selected ones of the openings in directions that extend substantially parallel to each other and that extend substantially perpendicular to the central plane;

c) the label dispensing means includes a plurality of rotatable components that cooperate to define a carrier web feed path that extends along a selected one of the first and second sides of the central mounting plate in spaced relationship thereto, with selected ones of the rotatable components being connected separate ones of the spindles for rotation relative to the axes of the spindles, with said carrier web feed path extending from a supply station located along one of the spindles, to the dispensing station and thence to a collection station located along another of the spindles;

d) the label dispensing means additionally includes a plurality of rotatable sprockets that are positioned on the side opposite to said selected side of the central mounting plate, including means for controllably drivingly connecting the sprockets to selected ones of the spindles, and having endless loop of drive chain reeved around portions of selected ones of the rotatable sprockets for transmitting rotary energy thereto from a designated one of the rotatable sprockets that is connected to a source of rotary energy that is supported by the frame structure along a path of movement that is followed by the drive chain;

e) a web supply reel is connected to the spindle located at the supply station, a collection reel is connected to the spindle located at the collection station, drag brake means is interposed between the supply spindle and the frame structure for permitting unreeling of label-carrying web material from the supply reel in response to tension that is applied thereto to overcome the operation of the drag brake, and slip clutch means drivingly interconnects one of the rotatable sprockets with the collection spindle for rotating the collection reel at only such speed as web material can be coiled onto the collection reel during operation of the tire labeling apparatus.

21. The apparatus of claim 20 additionally including:

a) first and second capstan rollers of substantially equal size connected to first and second ones of the spindles, respectively, with these capstan rollers being positioned on the web feed path side of the central mounting plate;

b) first and second electrically operated clutch mechanisms connected to the first and second ones of the spindles, respectively, and serving to selectively drivingly interconnect and disconnect said first and second ones of the spindles from receiving rotary motion when the roller chain is moved along its path of travel, with these clutch mechanisms being positioned on the roller chain side of the central mounting plate, and with these clutch mechanisms also including brakes that function to arrest rotary motion of the first and second capstan rollers when the clutch mechanisms are not operated to drivingly connect the first and second ones of the spindles, respectively, with first and second ones of the sprockets that drivingly engage the roller chain;

c) each of the electrically operated clutch mechanisms being separately operable so that its associated capstan roller alone can, if desired, be drivingly connected to the roller chain to receive rotary energy therefrom;

d) the first capstan roller being positioned along the web feed path and serving to tension the carrier web so as to effect its feeding along said path; and, e) the second capstan roller being positioned to drivingly engage the application roller when the application roller is in the dispensing station for rotating and angularly positioning the application roller.

22. The apparatus of claim 21 wherein:

a) sensor means is connected to the frame structure for detecting when a leading edge of a next-to-be-dispensed web-carried label has arrived at a predetermined position at the dispensing station to interact with said cooperating sensor means for detecting when the application roller is properly positioned at the dispensing station to receive a web-carried label that is to be peeled away from the web; and, b) said first and second clutch mechanisms are operative to concurrently rotate their associated capstan rollers to advance the web and to rotate the application roller so that a label is transferred to the application roller at the same speed at which the peripheral surface of the application roller is moving.

23. A label application apparatus for transferring labels one at a time from a dispensing station to an application station, and for applying labels to surfaces of rotating articles at the application station, comprising:

a) an application roller having a peripheral surface that extends substantially concentrically about a center axis;

b) carriage means including carriage structure connected to the application roller for supporting the application roller for rotation about its center axis;

c) frame means including frame structure connected to the carriage structure for supporting the carriage structure for movement relative to the frame structure for moving the application roller between a dispensing station wherein the peripheral surface of the application roller is positioned to receive labels that are delivered one at a time to the dispensing station, and an application station wherein the peripheral surface is positioned to transfer labels one at a time to surfaces of rotating articles;

d) label dispensing means connected to the frame means for delivering one label at a time to the dispensing station;

e) with the carriage means including first and second shafts, and mounting bracket means for supporting opposed end regions of the first and second shafts;

f) with the application roller being mounted on the first shaft at a location between opposed end regions thereof for rotation about said center axis;

g) with the first shaft extending substantially concentrically along said center axis of the application roller;

h) with the second shaft extending concentrically along a second axis that extends substantially parallel to but at a distance spaced from said center axis;

i) with a resilient roller having a relatively resilient peripheral surface that is mounted on the second shaft at a location between opposed end regions thereof for rotation about the second axis, and with the resilient roller being spaced from but extending in relatively close proximity to the application roller; and, j) with the mounting bracket means being configured to position the second axis such that, when the peripheral surface of the application roller is brought into engagement with surface portions of rotating articles at the application station to apply labels thereto, the peripheral surface of the resilient roller also is brought into engagement with such surface portion to assist the application roller in conforming the shapes of applied labels to the shapes of the article surfaces.

24. The apparatus of claim 23 wherein:

a) the resilient roller has relatively resilient peripheral surface portions that, when pressed into engagement with an article surface that is not flat, will deform to substantially conform to the shape of said article surface; and, b) the mounting bracket means is configured to position the second axis relative to said center axis such that, when the application roller is brought into engagement with an article surface portions that are not flat, the peripheral surface portions of the resilient roller are caused to deform to substantially conform to the shape of said article surface portions to assist the application roller in conforming the shapes of labels to the shapes of the article surfaces on which the labels are applied.

* * * * *